US006520514B2

(12) United States Patent
Clegg

(10) Patent No.: US 6,520,514 B2
(45) Date of Patent: Feb. 18, 2003

(54) PORTABLE FILING CASE WITH RETRACTABLE WHEELS AND HANDLE

(76) Inventor: Lee M. Clegg, 7 Esti Ct., Madison, NJ (US) 07940

( * ) Notice: Subject to any disclaimer, the term of this patent is extended or adjusted under 35 U.S.C. 154(b) by 0 days.

(21) Appl. No.: 09/768,916

(22) Filed: Jan. 24, 2001

(65) Prior Publication Data

US 2002/0096844 A1 Jul. 25, 2002

(51) Int. Cl.[7] ..... A63J 5/00

(52) U.S. Cl. ..... 280/47.26; 280/79.2; 312/249.8

(58) Field of Search ..... 40/790; 248/460; 16/114.1, 410, 416; 190/18 A, 39; 280/37, 47.26, 47.35, 79.2, 79.3, 47.315, 47.17; 312/233, 249.1, 249.11, 249.8, 249.12, 249.13

(56) References Cited

U.S. PATENT DOCUMENTS

| | | | | | |
|---|---|---|---|---|---|
| 2,439,660 | A | * | 4/1948 | Keil | 280/37 |
| 2,893,749 | A | * | 7/1959 | Simonsen | 280/47.26 |
| 2,905,480 | A | * | 9/1959 | Giovannelli | 280/47.26 |
| 3,351,402 | A | * | 11/1967 | Miller et al. | 312/233 |
| 4,026,616 | A | * | 5/1977 | Kuehl | 312/250 |
| 4,124,261 | A | * | 11/1978 | Klaus | 312/183 |
| 4,544,050 | A | * | 10/1985 | Seynhaeve | 190/39 |
| 4,784,382 | A | * | 11/1988 | Myers | 248/460 |
| 4,848,243 | A | * | 7/1989 | Giordano | 248/460 |
| 4,865,346 | A | * | 9/1989 | Carlile | 280/654 |
| 4,890,705 | A | * | 1/1990 | Pineda | 190/18 A |
| 5,207,723 | A | * | 5/1993 | Newby, Sr. | 312/249.11 |
| 5,306,029 | A | * | 4/1994 | Kaiser, II | 280/47.34 |
| 5,379,537 | A | * | 1/1995 | Roy | 40/790 |
| D383,603 | S | * | 9/1997 | Pedlar | 190/18 A |
| 6,199,816 | B1 | * | 3/2001 | Case | 248/460 |

* cited by examiner

*Primary Examiner*—Avraham Lerner
(74) *Attorney, Agent, or Firm*—Ezra Sutton

(57) ABSTRACT

A portable file case holder including a case housing having a rear wall, side walls, a top wall and a bottom wall for forming an interior compartment; the rear wall having an exterior wall surface and an interior wall surface; each of the side walls having an exterior wall surface and an interior wall surface; and each of the side interior wall surfaces include a plurality of paired, spaced-apart mounting receiving slots; and wherein each of the mounting receiving slots having U-shaped channels thereto for receiving the side edge of a shelving member. One or more of the shelving members for forming one or more compartments within the interior compartment of the case housing for receiving documents in the form of file folders, books, notebooks, 3-ring binders, manuscripts, transcripts, and/or computer print-outs. The case housing includes a detachable file case door having an exterior wall surface, an interior wall surface and a perimeter edging with a plurality of locking means thereon for covering the interior compartment. Each of the side exterior wall surfaces include a wheel receiving compartment; each of the wheel receiving compartments for receiving a tire wheel and wheel strut having a strut locking knob thereon. Each of the tire wheel and wheel strut having a first wheel retracted position within the wheel receiving compartment and a second wheel extended position extending from the wheel receiving compartment. The rear exterior wall surface includes a handle receiving compartment; the handle receiving compartment for receiving a case handle member having a handle locking knobs thereon; and the case handle member having a first handle retracted position within the handle receiving compartment and a second handle extended position extending from the handle receiving compartment.

38 Claims, 17 Drawing Sheets

PORTABLE FILING CASE WITH RETRACTABLE WHEELS AND HANDLE

FIELD OF THE INVENTION

This invention relates to a portable file case holder for the manual transporting of file folders, transcripts, books, manuscripts, 3-ring binders, notebooks and combinations thereof. More particularly, the portable filing case includes wheels and handle that are extendable and retractable for ease of movement when transporting, as well as, for ease of storage when stationary; and includes removable and stackable shelving for ease of storage of the 3-ring binders and/or manuscripts. Additionally, the portable filing case includes an air tight detachable file case door with locks for locking of the file case materials securely therein when in the transport mode.

BACKGROUND OF THE INVENTION

Several types of portable holders, carts, and cabinets for transporting records, files, books and the like have been utilized in the past. These types of portable record holders are used commercially by law firms, businesses, government agencies, as well as by homeowners for transporting records from one location to another location, and may be used in commercial establishments or homes.

These portable record holders or carts do not permit the easy transport of records and files on walkways, sidewalks, stairs, escalators, steep inclines and the like without causing damage to the portable holder or cart. Additionally, the portable record holder is not readily transportable in a vehicle trunk, as the case holder is too large for the vehicle trunk. Further, the contents of the case holders often spill out in the process of transporting the file contents within the vehicle or on an escalator or on a stairwell, as the case holder is unwieldy or unstable. The records, files, books, etc. often spill or fall out from the case holder when transporting those records. Typically, the contents have to be transferred to another file cabinet, book shelf, or file case holder in order for the user to efficiently use the records and files being transported.

There remains a need for a portable file case holder having extendable and retractable wheels and handle for the ease of movement when transporting the file case holder from one location to another location, as well as for the ease of storage and stabilization of the file case holder when not being transported or used from one location to another location. Further, the portable file case holder should have detachable, removable and stackable shelving for forming compartments for ease of handling and storing of the file case contents within each of the compartments. Also, the portable file case holder should have an air tight detachable file case door with locks for securely locking of the file case contents therein when the file case holder is in a transport mode.

DESCRIPTION OF THE PRIOR ART

Portable record holders, portable carts, and portable file cabinets for transporting of records having various designs, styles, configurations and materials of construction have been disclosed in the prior art. For example, U.S. Pat. No. 4,026,616, to KUEHL discloses a combination cabinet and roll out drawer cart. The cabinet includes a front opening having a roll out drawer being fitted therein. The roll out drawer may include a plurality of open shelves or carry several individual drawers which are supported within the roll out drawer. This prior art patent does not disclose the particular structure, design, configuration or function of the portable file case holder of the present invention having extendable and retractable wheels and handle; and with stackable and detachable shelving.

U.S. Pat. No. 4,124,261 to KLAUS discloses a data storage unit for storing computer print-out sheets. The data storage unit 10 includes at least one open-ended compartment and at least one portable binder adapted to be positioned horizontally in the compartment. The storage unit in another embodiment includes a plurality of smaller compartments being disposed in a horizontal position. This prior art patent does not disclose the particular structure, design, configuration or function of the portable file case holder of the present invention having extendable and retractable wheels and handle; and with stackable and detachable shelving.

U.S. Pat. No. 4,865,346 to CARLILE discloses a collapsible cart assembly for use in support of activities such as picnicking and beach-going events. The hand-propelled cart assembly includes a separable wheel frame having an upright section with upper and lower portions, respectively. The cart assembly also includes a foldable shelf member on the lower portion which supports a cooler chest and is provided with holding elements to preclude lateral shifting of the cooler chest during movement of the cart. This prior art patent does not disclose the particular structure, design, configuration or function of the portable file case holder of the present invention having extendable and retractable wheels and handle; and with stackable and detachable shelving.

U.S. Pat. No. 4,890,705 to PINEDA discloses a portable file cabinet with a retracting handle. The portable file cabinet includes a rectangular cabinet housing having a lid and having a pair of multifold file sections mounted on the interior surface of the lid. The interior of the file cabinet further includes a pair of storage compartments and a main record compartment with file dividers. A removable supply case is received within one of the compartments in the file cabinet. A pair of wheels and a retractable handle are mounted on the bottom surface of the file cabinet to provide ease of transportability by the user. This prior art patent does not disclose the particular structure, design, configuration or function of the portable file case holder of the present invention having extendable and retractable wheels and handle; and with stackable and detachable shelving.

None of these prior art patents teach or disclose the particular structure, design, configuration or function of the present invention of a portable file case holder having extendable and retractable wheels and handle for ease of movement when transporting the file case and for ease of storage when the file case is in a stationary or non-transport mode. Further, none of these prior art patents teach or disclose the particular structure and configuration of the present invention of a portable file case holder having detachable, removable and stackable shelving for forming compartments for ease of handling and storing of the contents within each of the compartments; and having an air tight detachable file case door with locks for securely locking of the file case contents/materials therein when the file case is in a transport mode.

Accordingly, it is an object of the present invention to provide a portable file case holder for the manual transporting of file folders, transcripts, books, manuscripts, notebooks, computer printouts and the like.

Another object of the present invention is to provide a portable filing case that includes extendable wheels and handle for the ease of movement when transporting the file case holder from one location to another location (i.e. from the user's car to the airport luggage check-in).

Another object of the present invention is to provide a portable filing case that includes retractable wheels and handle for ease of storage and stabilization of the file case holder when not being transported (or used) from one location to another location (i.e., when in the user's trunk or storage area; or when being transported in the cargo-hole of an airplane).

Another object of the present invention is to provide a portable filing case that includes detachable, removable and stackable shelving members for forming compartments for ease of handling and storing of the file case contents within each of the compartments.

Another object of the present invention is to provide a portable filing case that includes locking elements or connecting means for attaching and connecting the one or more of the removable shelving members to the mounting brackets of the frame assembly within file case holder such that the shelving members do not become detached from the mounting brackets of the frame assembly when the user is manually transporting the portable file case holder from one location to another location.

Another object of the present invention is to provide a portable filing case that includes an air tight detachable file case door with locks for securely locking of the file case contents therein, when the file case is in a transport mode.

Another object of the present invention is to provide a portable filing case that includes a lectern top assembly for use in court proceedings or business meetings, wherein the lectern top assembly is slidably attached to the top wall of the case housing.

Another object of the present invention is to provide a portable filing case that includes a lectern top accessory that is completely collapsible and easily broken-down, such that the lectern top assembly is stored in a storage compartment in the interior wall surface of the detachable file case door.

Another object of the present invention is to provide a portable filing case that includes a second storage compartment and a removable envelope door for storing business cards, envelopes, and general correspondence, being located on the exterior wall surface of the detachable file case door.

Another object of the present invention is to provide a portable filing case that is long-lasting, durable and lightweight being made from moldable plastic or metal such as aluminum or stainless steel.

A further object of the present invention is to provide a portable file case holder that can be mass produced in an automated and economical manner and is readily affordable by the consumer/user.

SUMMARY OF THE INVENTION

In accordance with the present invention, there is provided a portable file case holder including a case housing having a rear wall, side walls, a top wall and a bottom wall for forming an interior compartment; the rear wall having an exterior wall surface and an interior wall surface; each of the side walls having an exterior wall surface and an interior wall surface; and each of the side interior wall surfaces include a plurality of paired, spaced-apart mounting receiving slots; and wherein each of the mounting receiving slots having U-shaped channels thereto for receiving the side edge of a shelving member.

One or more of the shelving members for forming one or more compartments within the interior compartment of the case housing for receiving documents in the form of file folders, books, notebooks, 3-ring binders, manuscripts, transcripts, and/or computer print-outs. The case housing includes a detachable file case door having an exterior wall surface, an interior wall surface and a perimeter edging with a plurality of locking means thereon for covering the interior compartment.

Each of the side exterior wall surfaces include a wheel receiving compartment; each of the wheel receiving compartments for receiving a tire wheel and wheel strut having a strut locking knob thereon. Each of the tire wheel and wheel strut having a first wheel retracted position within the wheel receiving compartment and a second wheel extended position extending from the wheel receiving compartment.

The rear exterior wall surface includes a handle receiving compartment; the handle receiving compartment for receiving a case handle member having a handle locking knobs thereon; and the case handle member having a first handle retracted position within the handle receiving compartment and a second handle extended position extending from the handle receiving compartment.

BRIEF DESCRIPTION OF THE DRAWINGS

Further objects, features, and advantages of the present invention will become apparent upon consideration of the detailed description of the presently-preferred embodiments, when taken in conjunction with the accompanying drawings wherein.

DETAILED DESCRIPTION OF THE PREFERRED EMBODIMENT

Figure 1:
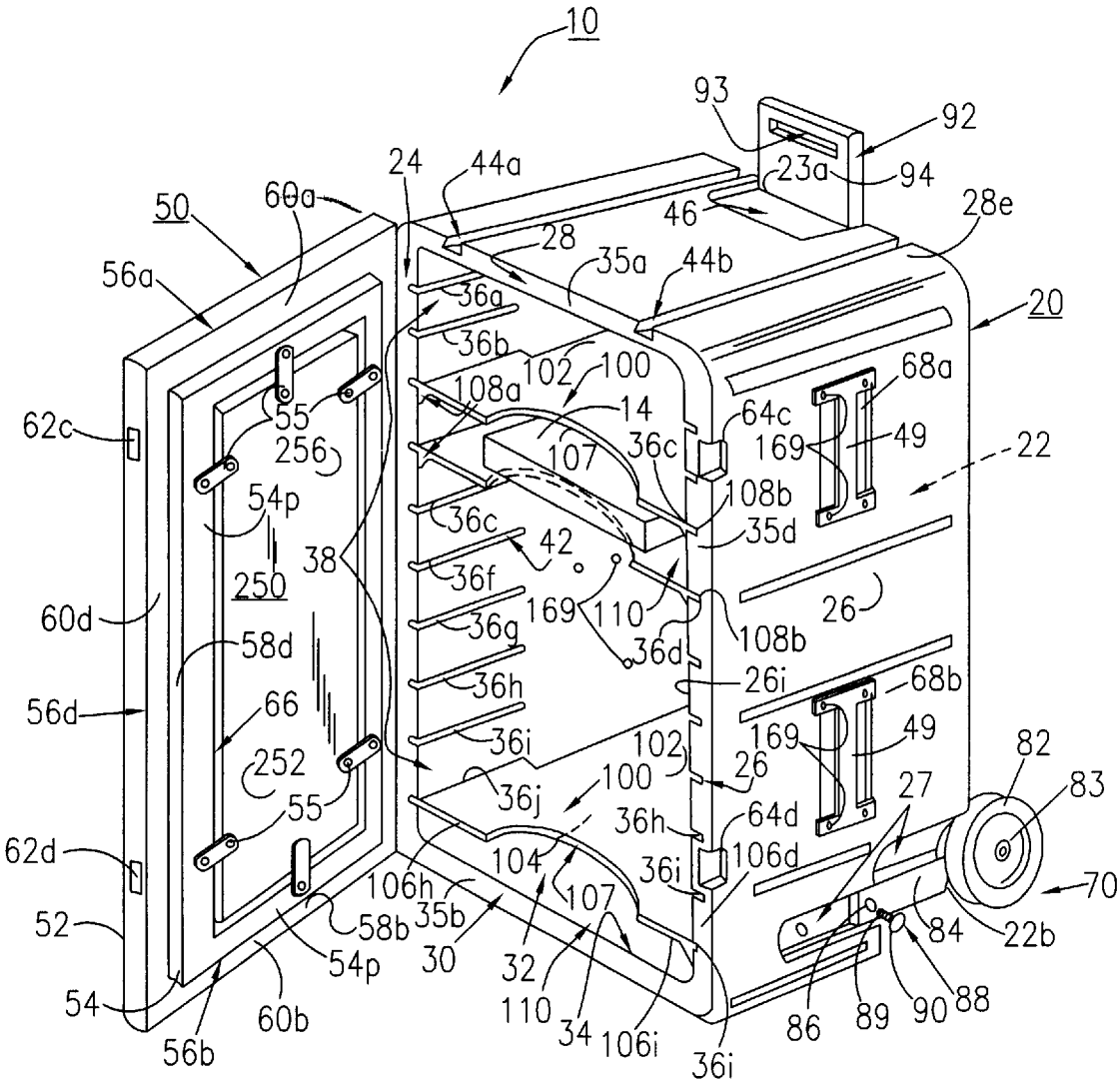
FIG. 1 is a front perspective view of the portable file case holder of the preferred embodiment of the present invention showing the file case holder in the assembled state and in an operational mode for transport by the user with a compartment storage area carrying a 3-ring binder thereon and the detachable file case door having a storage cavity for holding the folded and unassembled lectern top accessory therein.

The preferred embodiment of the present invention provides for a portable file case holder 10, as represented in FIGS. 1 through 11 of the patent drawings, for the manual transporting by a user of file folders 12, books and notebooks 14, 3-ring binders 16, manuscripts, transcripts and/or computer printouts 18 and the like. The portable file case holder 10 includes a case housing 20 having an interior frame assembly 38, an air tight detachable file case door 50 having locks 62*a*, 64*a*, 62*b*, 64*b*, 62*c*, 64*c*, 62*d*, 64*d*, respectively, and an extendable and retractable wheel assembly 70 and case handle 92. The portable file case holder 10 includes one or more detachable shelving member(s) 100, 120, 140 or 160 for forming compartments 110, 130, 150 or 170, respectively, therein.

As shown in FIGS. 1 through 4 of the drawings, the case housing 20 includes a rear wall 22 having an exterior wall surface 22*e*, side walls 24 and 26 having interior and exterior wall surfaces 24*i*, 26*i*, 24*e* and 26*e*, respectively, a top wall 28 and a bottom wall 30 for forming an interior compartment 32 and rectangular opening 34 having a perimeter edging 35*a*, 35*b*, 35*c* and 35*d*. Rear wall exterior surface 22*e* includes a handle (receiving) well 23 therein for slidably receiving case handle member 92 thereon in which to extend or retract the handle member 92. The rear wall exterior surface 22*e* also includes a beveled section 22*b* which allows the tire wheels 72 and 84 to contact the ground surface while the case holder 10 is tilted to a horizontal position (case holder 10 is in a closed configuration and the wheel assembly 70 is in a retracted position for storage) for a storage mode.

Figure 3:
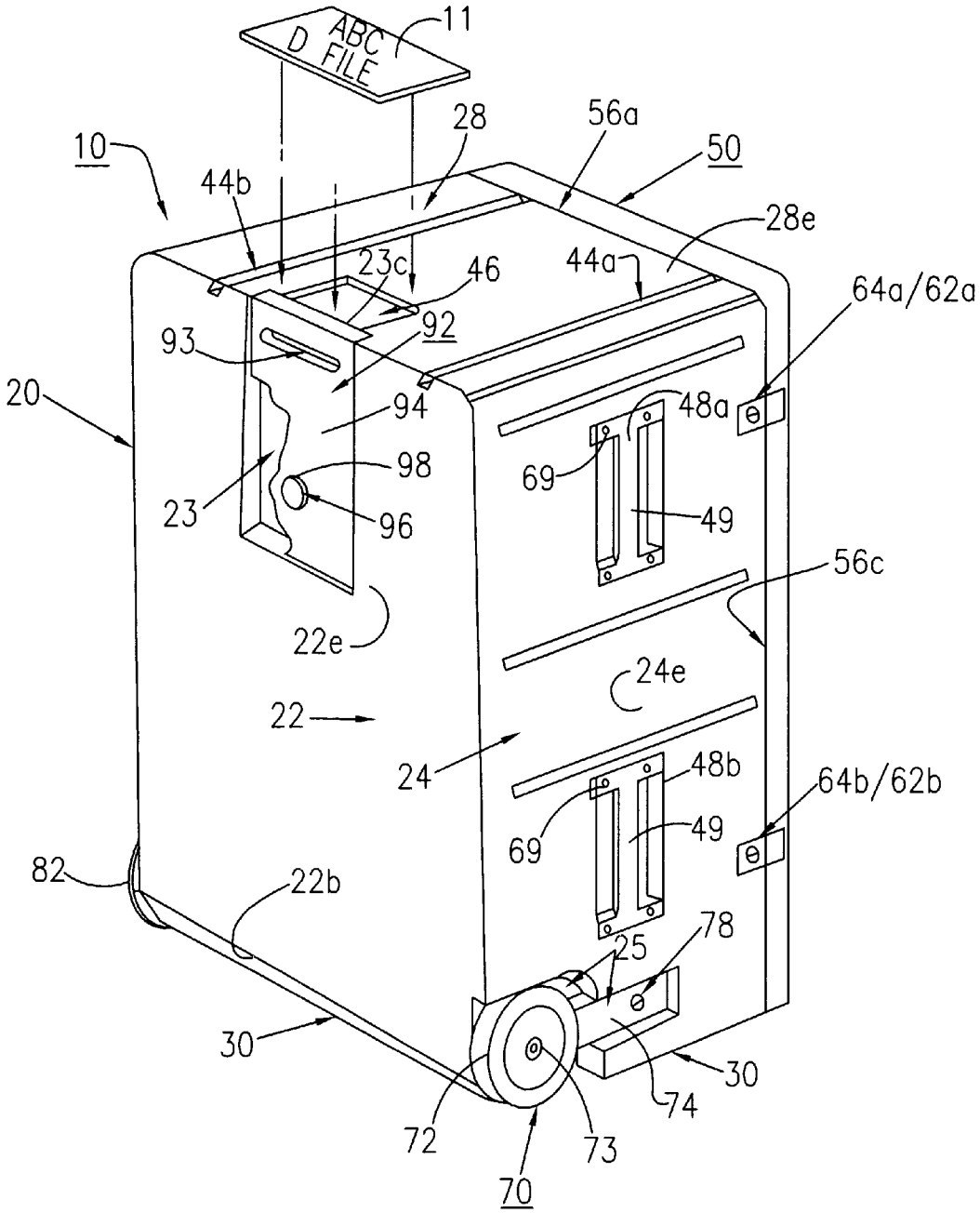
FIG. 3 is a rear perspective view of the portable file case holder of the present invention showing it in the assembled state and in an operational mode for storage by the user with the wheel assembly and case handle in the retracted position.

As shown in FIGS. 1 and 3, the top wall 28 of case housing 20 includes a pair of equally spaced-apart dove tailed-grooved channels 44*a* and 44*b* in which to slidably receive a pair of side support brackets 270*a* and 270*b* of the lectern top assembly 250. The top wall 28 of case housing 20 also includes a pocket compartment 46 for receiving a 3"×5" file card 11 therein. File card pocket compartment 46 is adjacent to the corner edge 23*c* of the handle receiving well 23 located on the exterior rear wall surface 22*e*.

Each side wall exterior surfaces 24*e* and 26*e* include a side wheel (receiving) well 25 and 27 therein for slidably receiving each of the tire wheels and wheel struts 72 and 74; and 82 and 84, respectively, thereon in which to extend or retract each of the tire wheels and wheel struts 72 and 74; and 82 and 84 of wheel assembly 70 for a transport or non-transport mode. Tire wheels 72 and 82 can be made of plastic or rubber. Wheel struts 74 and 84 can be made of plastic or metal.

Figure 16:
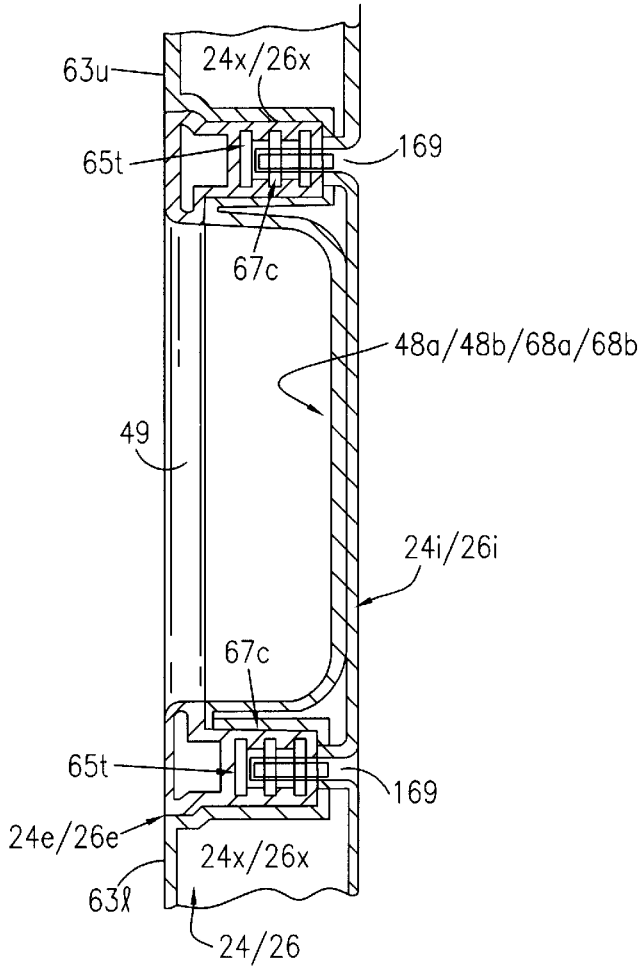
FIG. 16 is an enlarged cross-sectional view of the portable file case holder of the present invention taken along lines 16—16 of FIG. 15 showing the threaded inserts for the file case handle attached to the side wall of the case housing.

As shown in FIGS. 1 through 4 and 15, each of the exterior side wall surfaces 24*e* and 26*e* further include a pair of centrally located carrying handle (receiving) wells/compartments 48*a* and 48*b*; and 68*a* and 68*b*, respectively, therein. Each of the adjacent edges of the carrying handle receiving compartments 48*a*, 48*b*, 68*a* and 68*b* receive a fixed carrying handle 49 thereon. Each of the fixed carrying handles 49 are fixedly connected over each of carrying handle receiving compartments 48*a*, 48*b*, 68*a* and 68*b* by rivet pins or screws 169 via the threaded inserts 65*t* molded within the insert holding chambers 67*c* located at the upper and lower sections 63*u* and 63*l* of each carrying handle compartment 48*a*, 48*b*, 68*a* and 68*b*, respectively. Each insert holding chamber 67*c* is located within the interior area 24*x* and 26*x* of each side wall 24 and 26, respectively, as shown in FIG. 16 of the drawings. Carrying handles 49 are used by the user for lifting the portable file case holder from one position to another position (i.e. from the user's car trunk to the ground).

Figure 1A:
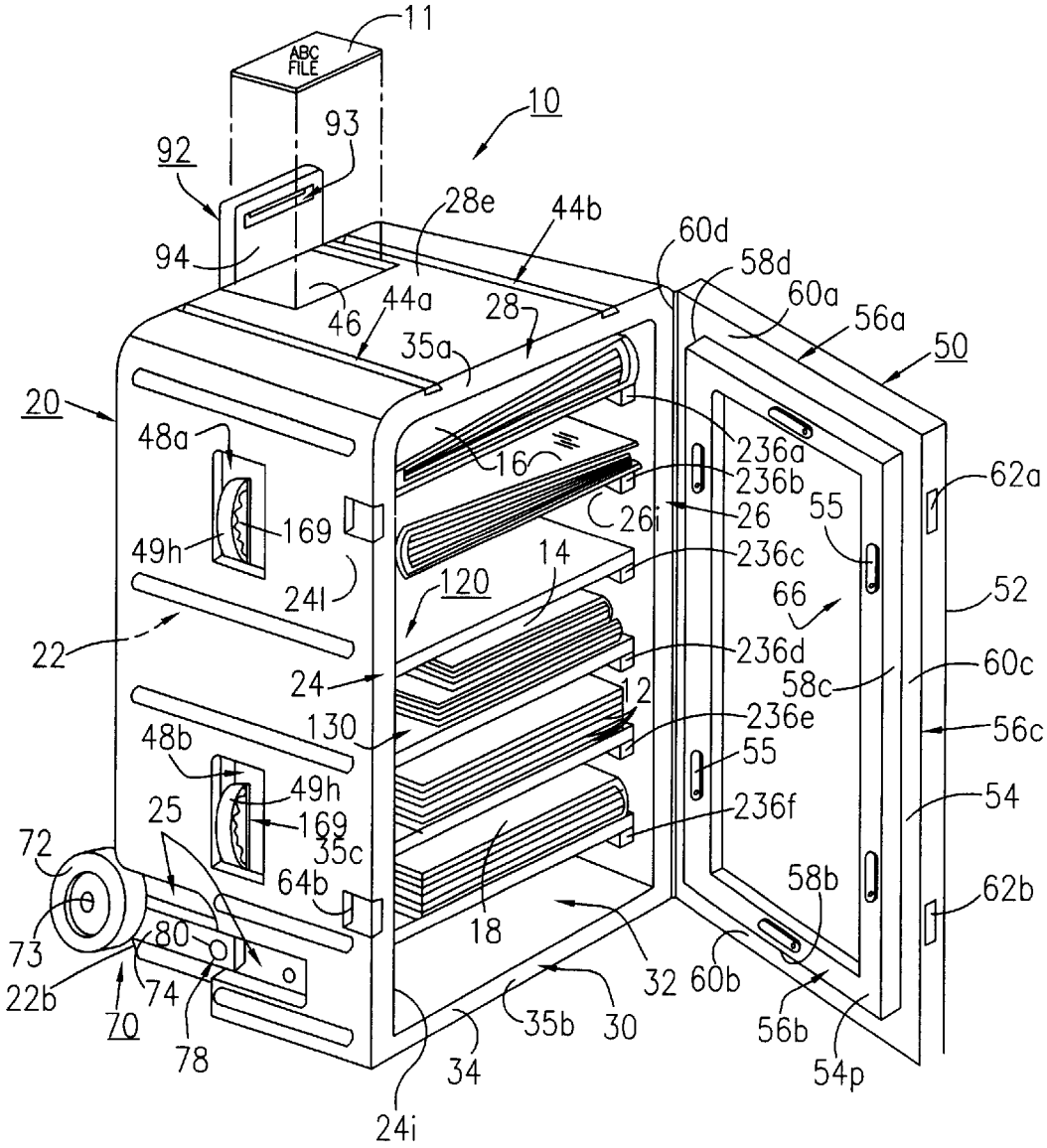
FIG. 1A is a front perspective view of the portable file case holder of an alternate embodiment of the present invention showing the file case holder in the assembled state and in an operational mode for transport by the user with the plurality of compartment storage areas carrying a load of case folders, 3-ring binders, books and manuscripts therein.
Figure 1B:
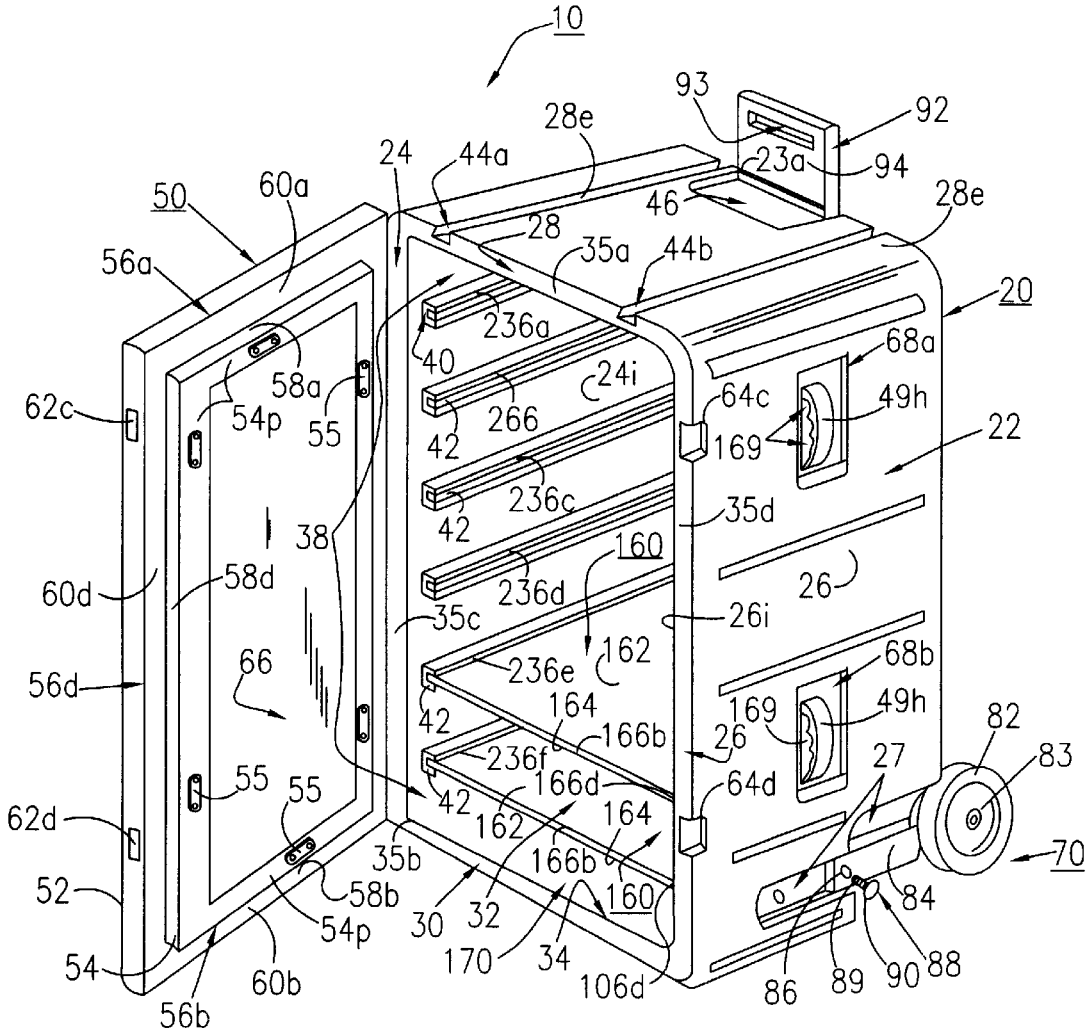
FIG. 1B is a front perspective view of the portable file case holder of an alternate embodiment of the present invention showing the file case holder in an empty mode being readied for operational use with the wheel assembly and case handle in the extended position.
Figure 5A:
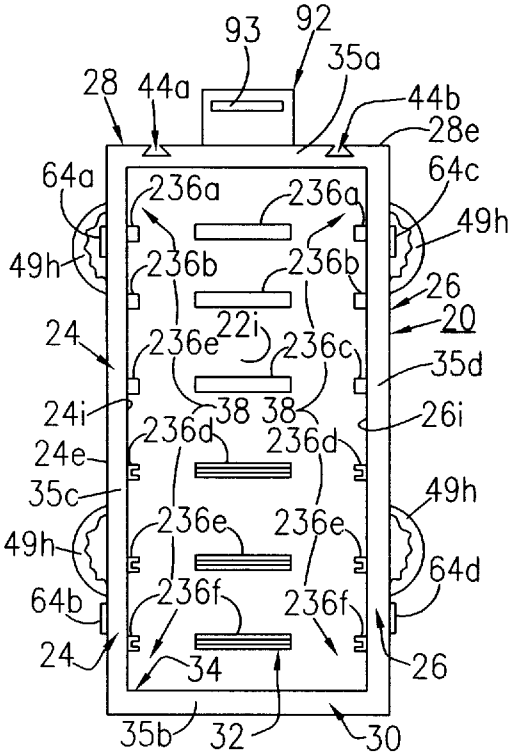
FIG. 5A is a front elevational view of the portable file case holder of the alternate embodiment of the present invention showing the case housing, the case handles, the plurality of spaced-apart mounting brackets for receiving one or more shelving members thereon, and a pair of locking members on each of the side walls.

Alternatively, as shown in FIGS. 1A, 1B and 5A, each of the exterior side wall surfaces 24*e* and 26*e* include a pair of centrally located carrying handle (receiving) wells/compartments 48*a* and 48*b*; and 68*a* and 68*b*, respectively, therein. Each of the carrying handle receiving compartments 48*a*, 48*b*, 68*a* and 68*b* receive a hinged carrying handle 49H therein. Each of the hinged carrying handles 49H are fixedly connected within each of carrying handle receiving compartments 48*a*, 48*b*, 68*a* and 68*b* by rivet pins 169. Carrying handles 49H are used by the user for lifting the portable file case holder from one position to another position (i.e. from the user's car trunk to the ground).

Figure 2:
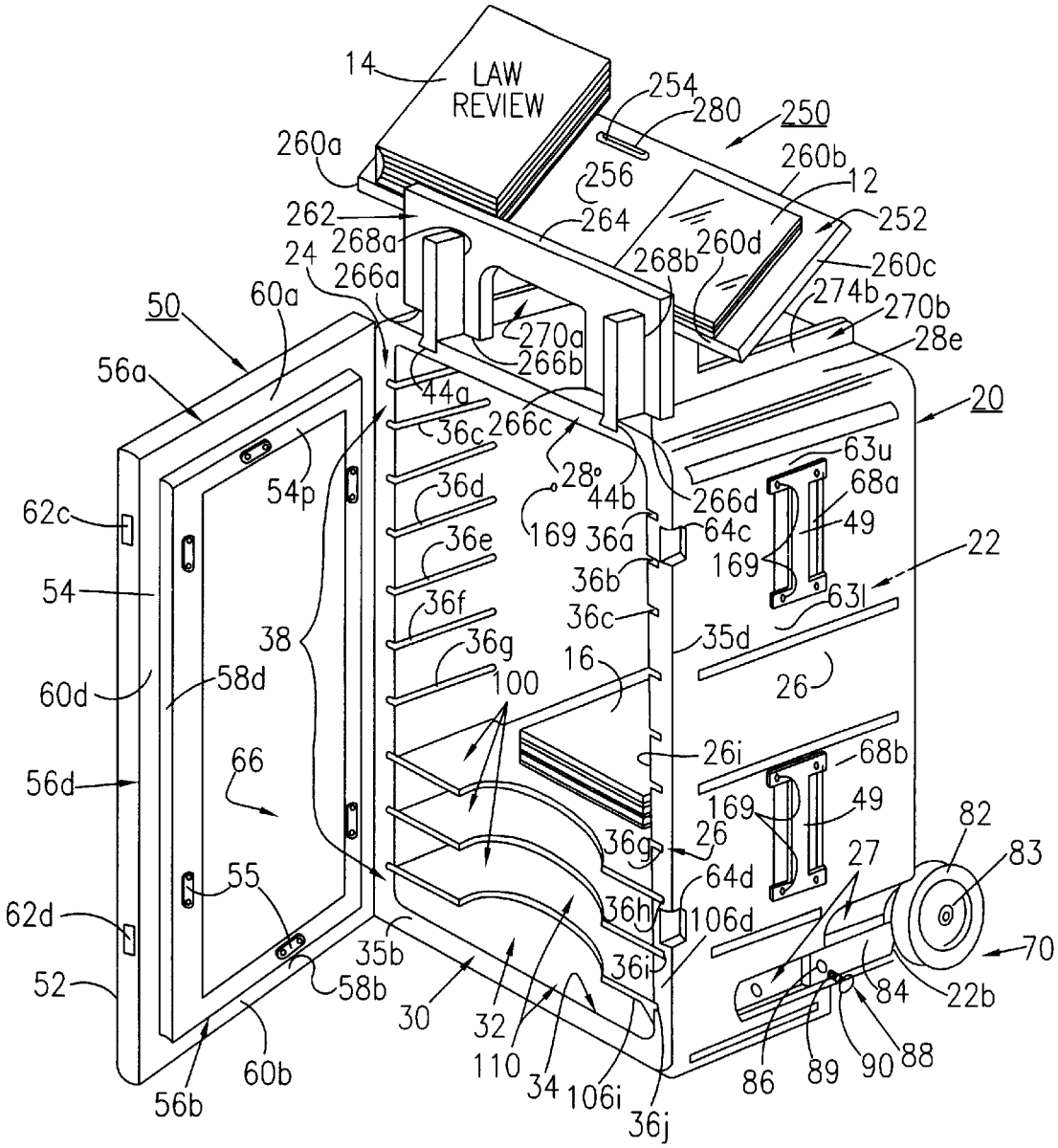
FIG. 2 is a front perspective view of the portable file case holder of the preferred embodiment of the present invention showing the file case holder in an empty mode being readied for operational use with the lectern top accessory in a fully assembled configuration and the wheel assembly in the extended position.
Figure 5:
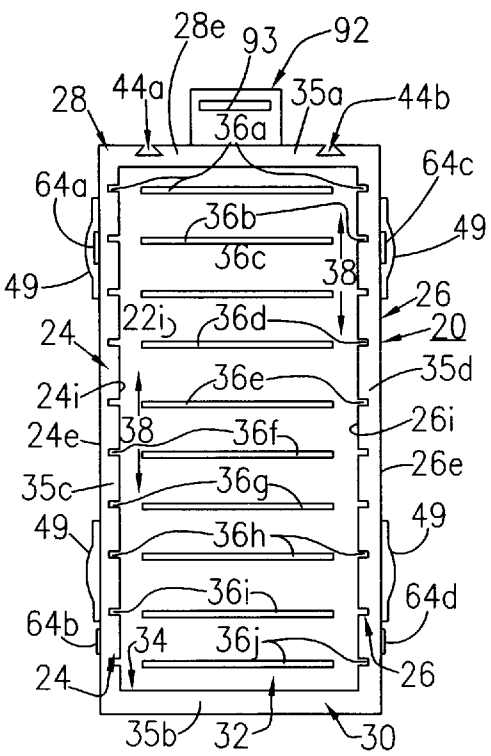
FIG. 5 is a front elevational view of the portable file case holder of the present invention showing the case housing, the case handles, the plurality of spaced-apart sets of mounting receiving slots for receiving one or more shelving members thereon, and a pair of locking members on each of the side walls.

The interior compartment 32, as shown in FIGS. 1, 2 and 5 of the drawings, includes a plurality of evenly, spaced-apart sets of mounting receiving slots 36*a*, 36*b*, 36*c*, 36*d*, 36*e*, 36*f*, 36*g*, 36*h*, 36*i* and 36*j* being located and positioned on each of the interior rear and side wall surfaces 22*i*, 24*i* and 26*i*, respectively, for forming an interior frame assembly 38. Each set of mounting receiving slots 36*a* to 36*j* includes connecting means 40 in the form of U-shaped receiving channels 42, in order to receive one or more of the shelving members 100 for forming compartments 110.

In alternate embodiments, the interior compartment 32, as shown in FIGS. 1A, 1B and 5A of the drawings, includes a plurality of evenly, spaced-apart and paired mounting brackets 236*a*, 236*b*, 236*c*, 236*d*, 236*e* and 236*f* being located and positioned on each interior side wall surface 24*i* and 26*i*, respectively, for forming an interior frame assembly 38. Each paired mounting bracket 236*a* to 236*f* includes connecting means 40 in the form of U-shaped channels 242, a pair of circular receiving ports 244 or receiving slots/grooves 246 in order to receive one or more of the shelving members 120, 140 or 160 for forming compartments 130, 150 or 170, respectively. Additional mounting brackets 236*a* to 236*f*, as shown in FIG. 5A of the drawings, are attached to the interior rear wall surface 22*i* for providing further shelving stability when the shelving members 120, 140 or 160 are loaded with documents in the form of the file folders, general correspondence, books, notebooks, 3-ring binders, manuscripts, transcripts, and/or computer printouts, etc.

Figure 4:
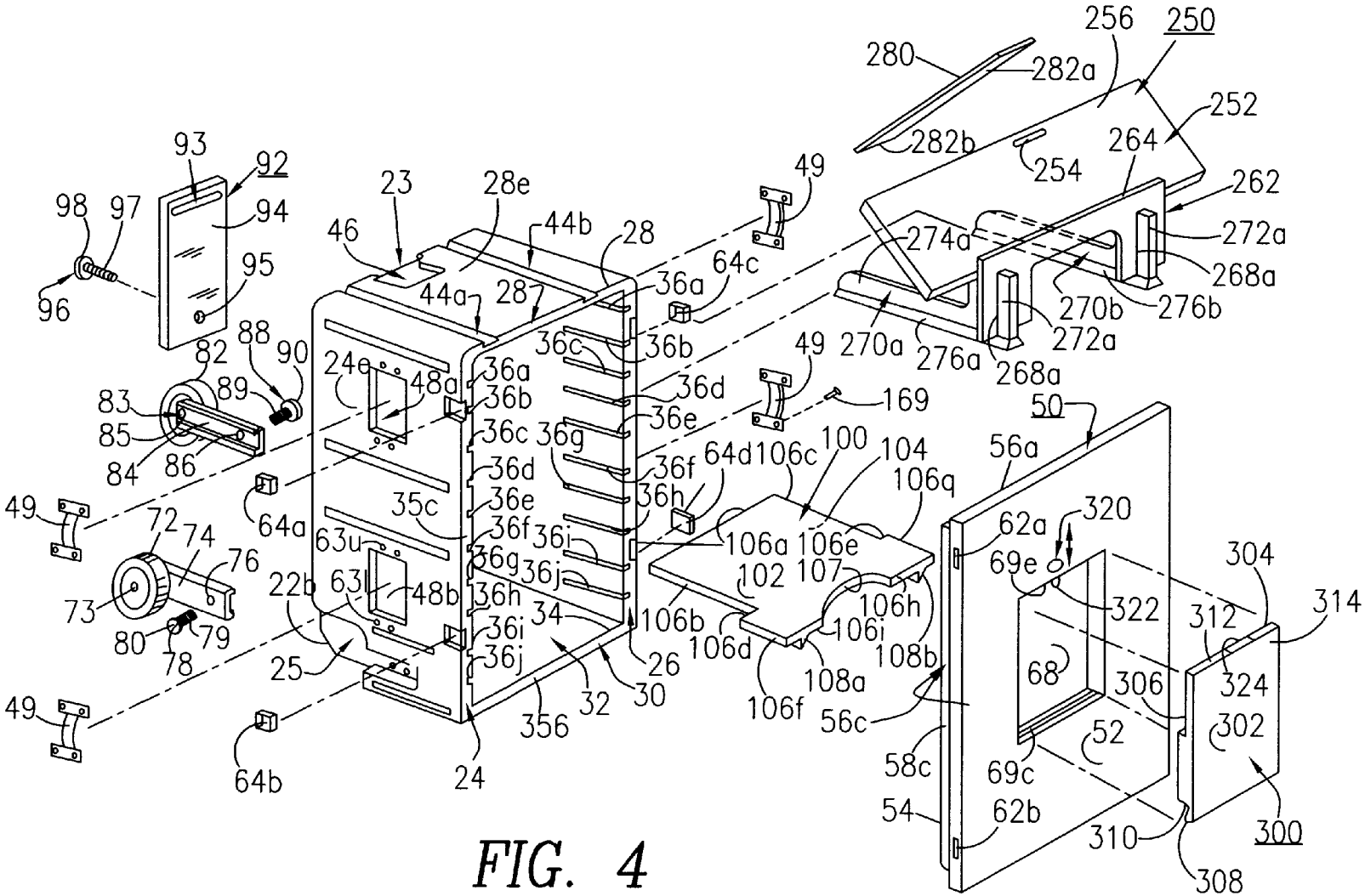
FIG. 4 is an exploded front perspective view of the portable file case holder of the present invention showing the case handles, the wheel assembly, the case housing, the plurality of shelving channels for forming compartment storage areas with a storage shelf, and the detachable file case door with locks.
Figure 6:
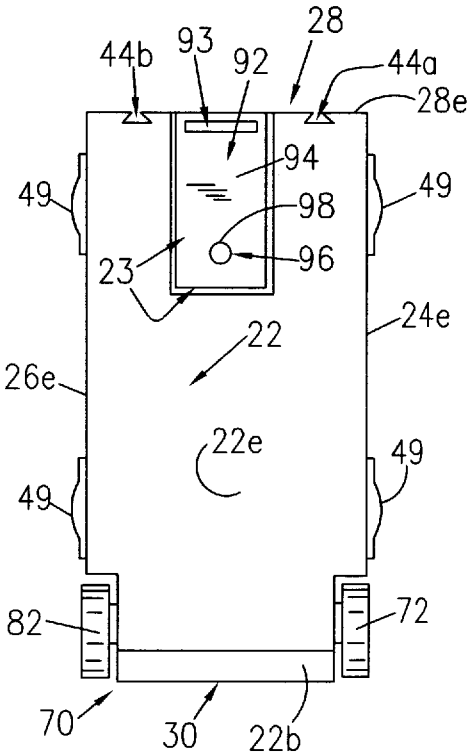
FIG. 6 is a rear elevational view of the possible file case holder of the present invention showing the case housing, the case handle, the wheel assembly, and a pair of locking members on each of the side walls.

As shown in FIGS. 1 through 4, 17 and 18 of the drawings, the air tight detachable file case door 50 includes an exterior wall surface 52, an interior wall surface 54 and a stepped recessed perimeter edging 56*a*, 56*b*, 56*c* and 56*d*. Interior wall surface 54 includes a lectern top storage compartment 66 for receiving therein the lectern top assembly 250 and the exterior wall surface 52 includes a door pouch/storage compartment 68 for receiving therein the detachable and removable envelope door 300. Exterior wall surface 52 also includes a latch lock member 320 having latching tab member 322 for shutting the envelope door to a closed position. The perimeter wall surfaces 54*p* includes a plurality of retaining clips 55 for holding the lectern top assembly 250 in place when being stored in the lectern top storage compartment 66, as depicted in FIG. 1 of the drawings. Stepped recessed perimeter edging 56*a* to 56*d* includes an inner portion section 58*a*, 58*b*, 58*c* and 58*d* for mating with the interior rectangular opening 34 and an outer perimeter section 60*a*, 60*b*, 60*c* and 60*d* for engaging and contacting with the exterior perimeter edging 35*a*, 35*b*, 35*c* and 35*d*, respectively, in order to form an air tight bond of the detachable file case door 50 with that of the file case housing 20. Each of the side outer perimeter sections 60*c* and 60*d* includes a pair of lock receiving slots 62*a*, 62*b*, 62*c* and 62*d*, respectively, thereon for receiving the catch locking tabs 64*a*, 64*b*, 64*c* and 64*d* thereto, as shown in FIGS. 1 to 4 of the drawings. Catch locking tabs 64*a*, 64*b*; and 64*c* and 64*d* are positioned on each side exterior wall surface 24*e* and 26*e* being adjacent to exterior perimeter edging 35*c* and 35*d*, respectively, as shown in FIGS. 2 and 4 of the drawings.

Figure 7:
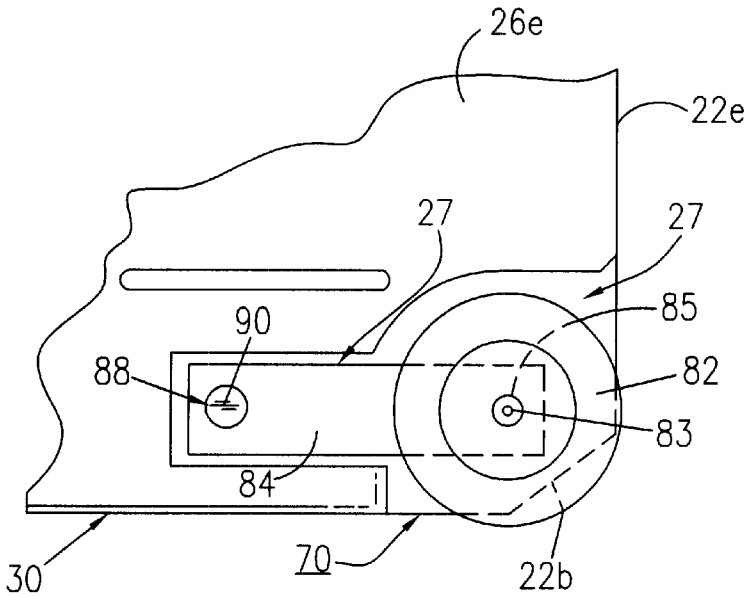
FIG. 7 is a side elevational view of the portable file case holder of the present invention showing the case housing and one wheel of the wheel assembly in a non-extended position.
Figure 8:
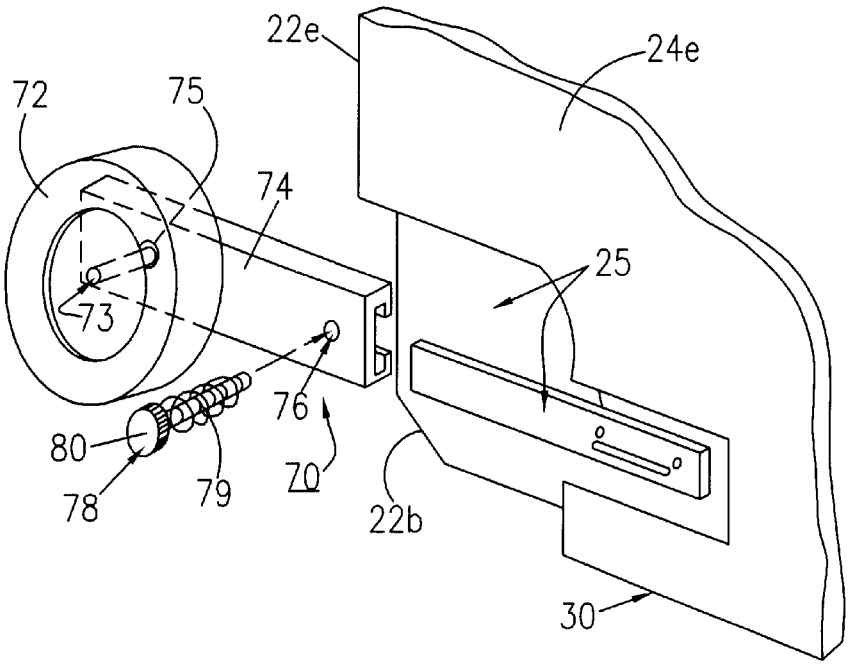
FIG. 8 is an enlarged perspective view of the portable file case holder of the present invention showing one wheel and wheel strut of the wheel assembly being slidably connected to the wheel well.

Wheel assembly 70 as shown in FIGS. 4, 7 and 8 of the drawings, includes a first tire wheel and axle 72 and 73, and a first slidable wheel strut 74 having a wheel strut opening 74*s*. First wheel strut opening 74*s* is slidably received on slide plate 77. First slidable wheel strut 74 includes a first opening 75 for receiving wheel axle 73 therein and a second threaded opening 76 for receiving a threaded locking member 78 therein. Locking member 78 includes a turning knob 80 mounted on a threaded bolt 79. Wheel assembly 70 also includes a second tire wheel and axle 82 and 83, and a second slidable wheel strut 84 having a wheel strut opening 84*s*. Second wheel strut opening 84*s* is slidably received on slide plate 87. Second slidable wheel strut 84 includes a first opening 85 for receiving wheel axle 83 therein and a second threaded opening 86 for receiving a threaded locking member 88 therein. Locking member 88 includes a turning knob 90 mounted on a threaded bolt 89. Each of the tire wheels and wheel struts 72 and 74; and 82 and 84 are slidably received with each of the slide plates 77 and 87 within the side wheel wells 25 and 27, respectively, in which to extend or retract each of the tire wheels and wheel struts 72 and 74; and 82 and 84 accordingly when in a transport or non-transport mode, as shown in FIGS. 1, 2 and 3 of the drawings.

Case handle member 92, as shown in FIGS. 1 to 3 and 6 of the drawings, includes a handle opening 93, a sliding section 94 having a threaded opening 95 therein for receiving a threaded handle locking member 96 therein. Handle locking member 96 includes a turning knob 98 mounted on a threaded bolt 97. Case handle member 92 is slidably received within the exterior rear wall handle well 23 in which to extend or retract the case handle member 92 accordingly when in a transport or non-transport mode, as shown in FIGS. 1 and 3 of the drawings.

Shelving members 100 connect and are slidably received within each set of mounting slots 36*a* to 36*j*, as depicted in FIGS. 1, 2 and 5 of the drawings. The detachable, removable and stackable shelving member 100 includes a top wall surface 102, a bottom wall surface 104, perimeter edging 106*a*, 106*b*, 106*c*, 106*d*, 106*e*, 106*f*, 106*g*, 106*h* and 106*i* and a curved (cut-out) perimeter edging 107. Shelving members 100 also include a pair of elongated holding tabs 108*a* and 108*b* being parallel and adjacent to perimeter edging 106*f* and 106*g*, respectively. The holding tabs 108*a* and 108*b* reinforce shelving member 100 from bending, as well as give shelving member 100 a tight fit when inserted into a particular set of mounting slots 36*a* to 36*j*, as depicted in FIG. 1 of the drawings. In forming compartment 110, as shown in FIGS. 1 and 2, the user simply inserts side perimeter edges 106*f* and 106*g* and rear perimeter edge 106*a* of shelving members 100 into the U-shaped channels 42 of a particular set of mounting slots 36*a* to 36*j* and slides each of the shelving members 100 inwardly.

Figure 9:
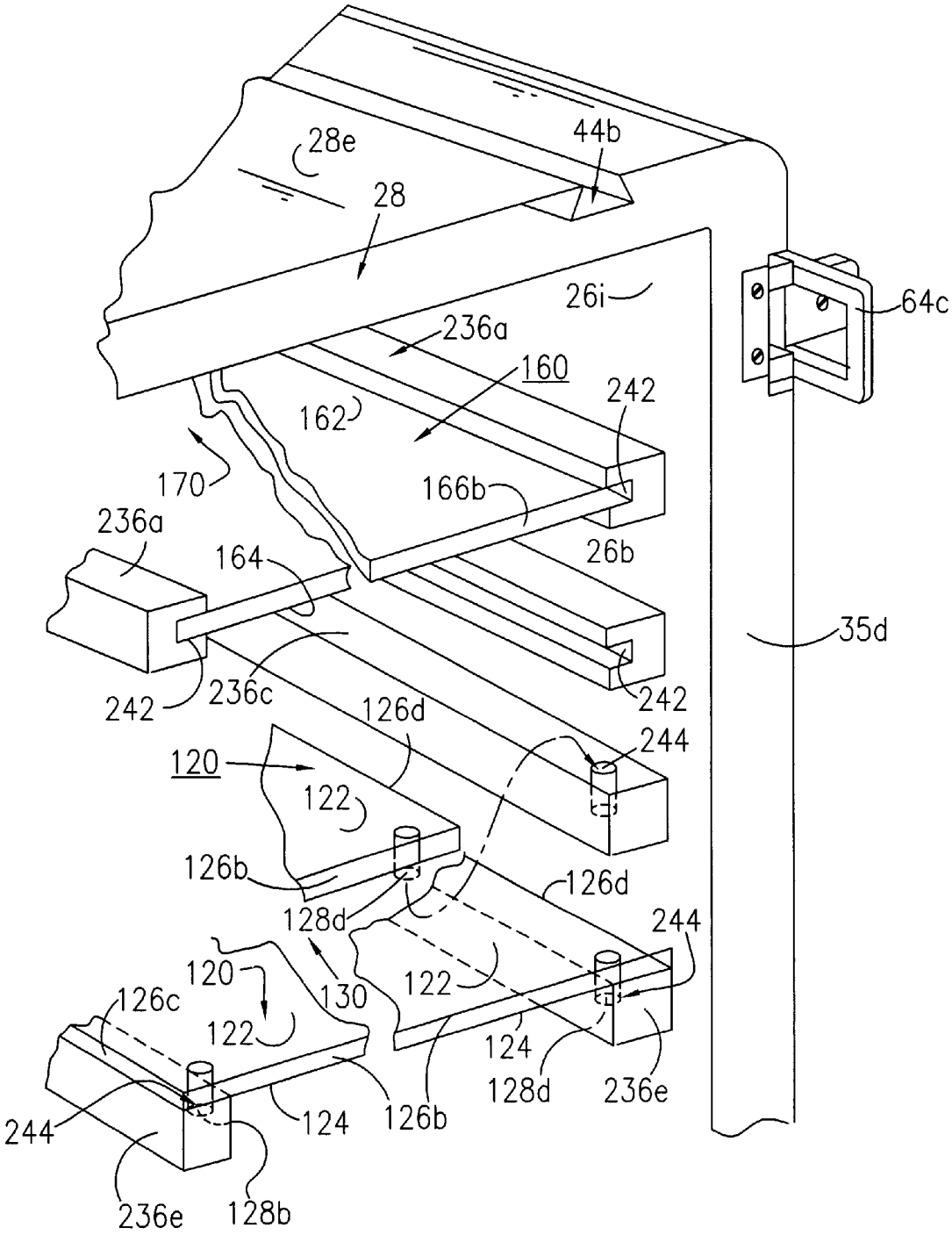
FIG. 9 is a partially exploded enlarged perspective view of the portable file case holder of the present invention showing the plurality of spaced-apart mounting brackets on the side wall of the case housing having connecting means thereon for receiving a plurality of shelving members therein.

Alternatively, shelving members 120, 140 and 160 connect and attach to mounting brackets 236*a* to 236*f* by various connecting means previously discussed. For example, detachable, removable and stackable shelving member 120 includes a top wall surface 122, a bottom wall surface 124 and perimeter edging 126*a*, 126*b*, 126*c* and 126*d*. Shelving member 120 also includes a plurality of cylindrical tab members 128*a*, 128*b*, 128*c* and 128*d* being integrally connected to the bottom wall surface 124 and positioned such that tab members 128*a* to 128*d* (2 each) are adjacent to perimeter edge 126*c* and 126*d*, respectively, as shown in FIGS. 4 and 9 of the drawings. In forming compartment 130, the user simply mates the cylindrical tab members 128*a* to 128*d* of shelving member with the circular receiving ports 244 on each pair of mounting brackets 236*c* and 236*d* for a tight fit, as depicted in FIG. 9 of the drawings.

Figure 10:
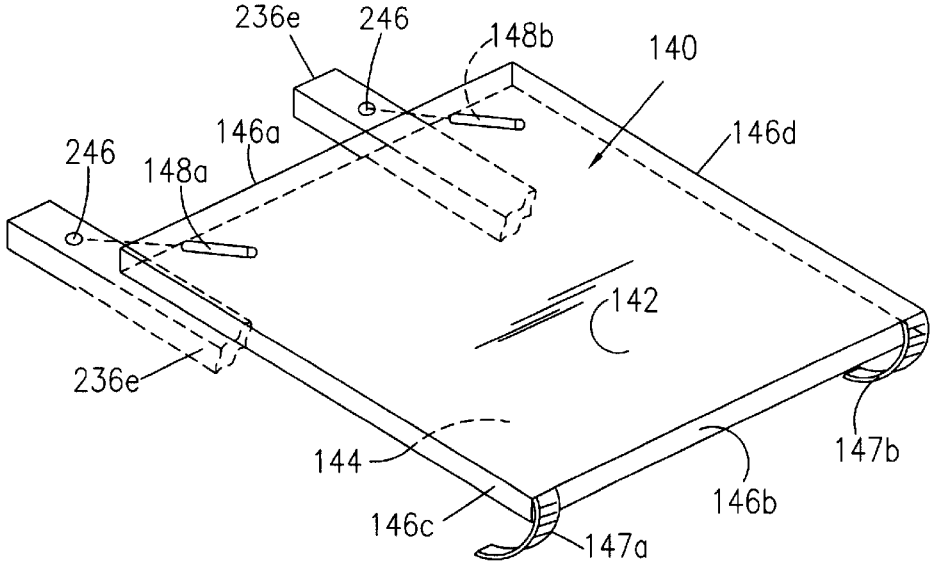
FIG. 10 is a partial perspective view of the portable file case holder of the present invention showing an alternate shelving member being received on the rear portions of a pair of mounting brackets thereto.
Figure 11:
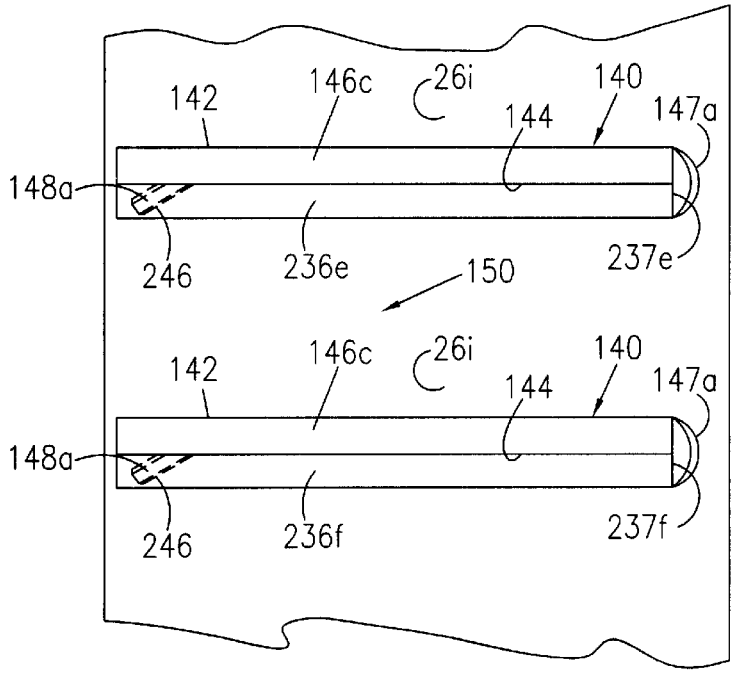
FIG. 11 is a partial side elevational view of the portable file case holder of the present invention showing the alternate shelving members attached to two spaced-apart mounting brackets within the case housing.

Detachable, removable and stackable shelving member 140 includes a top wall surface 142, a bottom wall surface 144 and perimeter edging 146*a*, 146*b*, 146*c* and 146*d*. Shelving member 140 also includes a pair of front J-shaped clamping members 147*a* and 147*b* located at each corner of the perimeter edge 146*b* and a pair of rear insert tabs 148*a* and 148*b* integrally connected to the bottom wall surface 144 being positioned at the corners and adjacent to each perimeter edge 146*c* and 146*d*, respectively, as shown in FIGS. 10 and 11 of the drawings. In forming compartment 150, the user simply mates the rear insert tabs 148*a* and 148*b* of shelving member 140 with that of the rear grooves/slots 246 of mounting brackets 236*e* and 236*f* and snaps on the front J-shaped clamping members 147*a* and 147*b* of shelving member 140 to the front leading edge 237*c* and 237*f* of mounting brackets 36*e* and 36*f* for a tight fit, as depicted in FIG. 11 of the drawings.

Detachable, removable and stackable shelving member 160, as shown in FIGS. 1B and 9, includes a top wall surface 162, a bottom wall surface and perimeter edging 166*a*, 166*b*, 166*c* and 166*d*. In forming compartment 170, as shown in FIG. 9, the user simply inserts perimeter edges 166*c* and 166*d* of shelving member 160 into the U-shaped channels 242 of each pair of mounting brackets 236*a* and 236*b* and slides shelving members 160 inwardly.

Each of the aforementioned connecting means 40 insures that shelving members 100, 120, 140 or 160 will not dislodge during transport from one location to another location and the formed compartments 110, 130, 150 or 170 will stay intact during transport.

Figure 12:
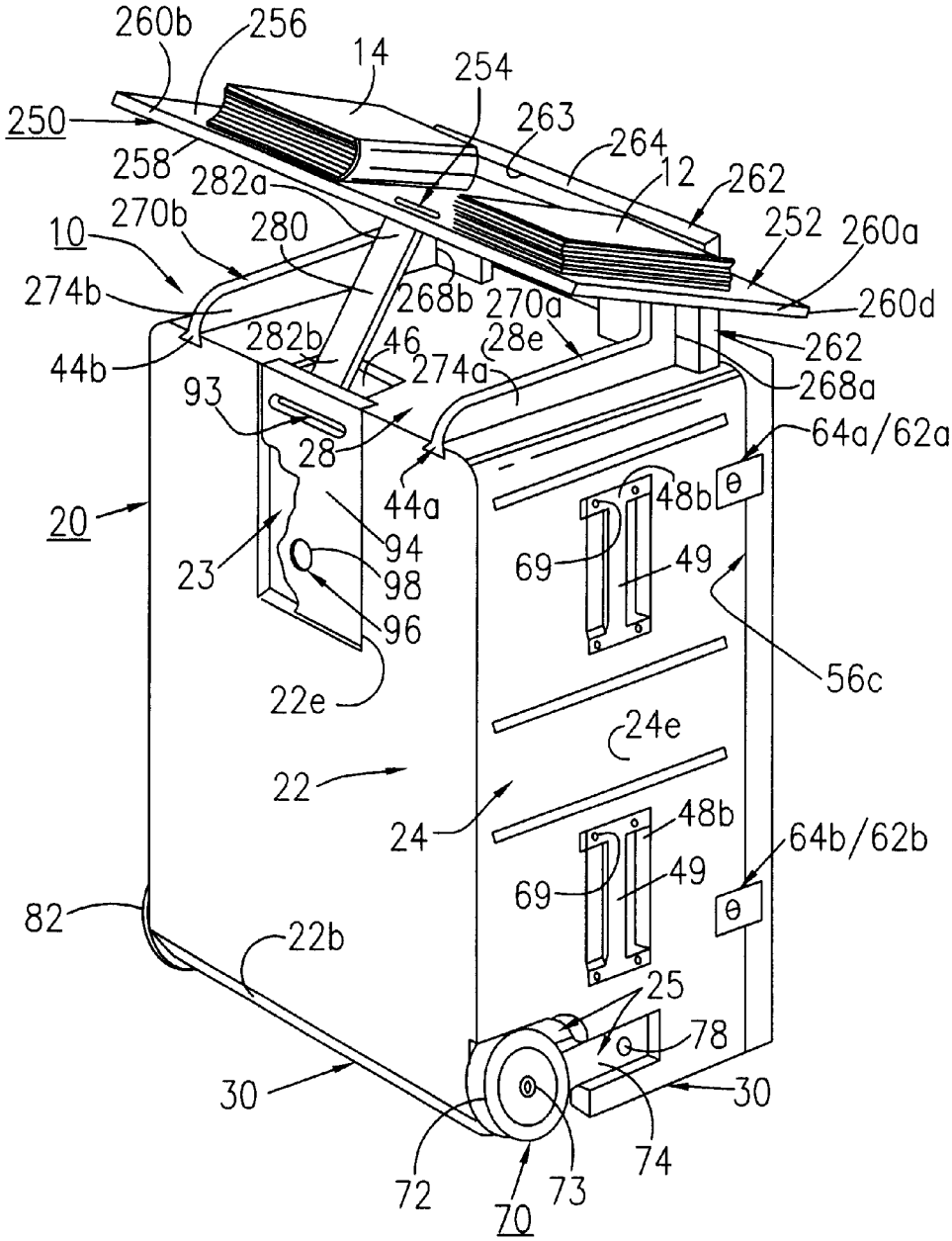
FIG. 12 is a rear perspective view of the portable file case holder of the present invention showing the lectern top accessory and its component parts in a fully assembled state and in operational use thereof.
Figure 13:
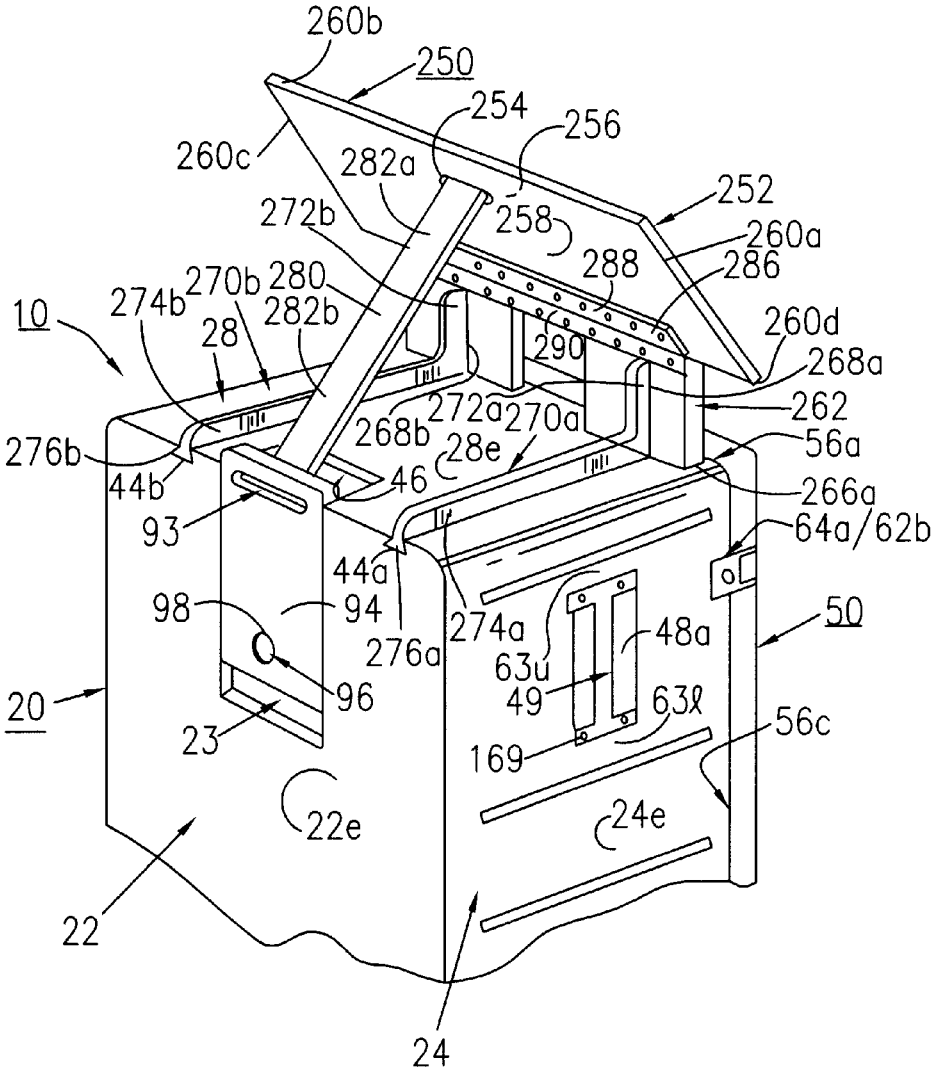
FIG. 13 is a partial upper rear perspective view of the portable file case holder of the present invention showing the lectern top accessory and its component parts in a fully assembled state.

The lectern top assembly 250, as shown in FIGS. 1, 2, 12, 13 and 14 of the drawings, includes a lectern tabletop 252 having a bracing slot opening 254 therein, a front U-shaped support bracket 262 having a pair of slotted grooves 268*a* and 268*b* therein, a pair of L-shaped side support brackets 270*a* and 270*b*, a support brace 280, and a connecting hinge 286 for connecting the lectern tabletop 252 to the front U-shaped support bracket 262. The lectern tabletop 252 includes a front wall surface 256, a rear wall surface 258 and perimeter side edges 260*a*, 260*b*, 260*c* and 260*d*, respectively. Support bracket 262 includes an upper perimeter edge 264, and a plurality of lower perimeter edges 266*a* to 266*d* which are in contact with the top exterior wall surface 28*e* of the case housing 20. Hinge 286 includes an upper hinge section 288 and a lower hinge section 290. The upper hinge section 288 is attached to the rear wall surface 258 adjacent to the bottom perimeter side edge 260*d* and the lower hinge section 290 is attached to the upper interior wall surface 263 adjacent to the upper perimeter edge 264, as shown in FIGS. 12 and 13 of the drawings. Also, the upper interior wall surface 263 acts as a holding guard for papers, notes, books 14 when the lectern top assembly 250 is in the fully assembled configuration, as depicted in FIG. 12 of the drawings.

Each of the L-shaped side support brackets 270*a* and 270*b* include a vertical section member 272*a* and 272*b*, and a horizontal section member 274*a* and 274*b*, respectively. Each of the horizontal section members 274*a* and 274*b* include a dove tailed-shaped tab member 276*a* and 276*b*, for being received within the spaced-apart dove tailed-grooved channels 44*a* and 44*b*, respectively, as shown in FIGS. 1 and 12 of the drawings, located on the top wall 28 of case housing 20. Each of the vertical section members 272*a* and 272*b* are received within the pair of slotted grooves 268*a* and 268*b*, respectively, of the front U-shaped support bracket 262 in which to support the front U-shaped support bracket 262 in a vertical position, as depicted in FIG. 2 of the drawings.

The support brace 280 includes a first end 282*a* and a second end 282*b*. The first end 282*a* of support brace 280 is received within the bracing slot opening 254 and the second end 282*b* of support brace 280 is received against the case handle member 92 or within a portion of the handle opening 93 of the case handle member 92 in which to support the lectern tabletop 252 in a 45° degree angle, when in a fully assembled state, as shown in FIGS. 2, 12 and 13 of the patent drawings.

Figure 14:
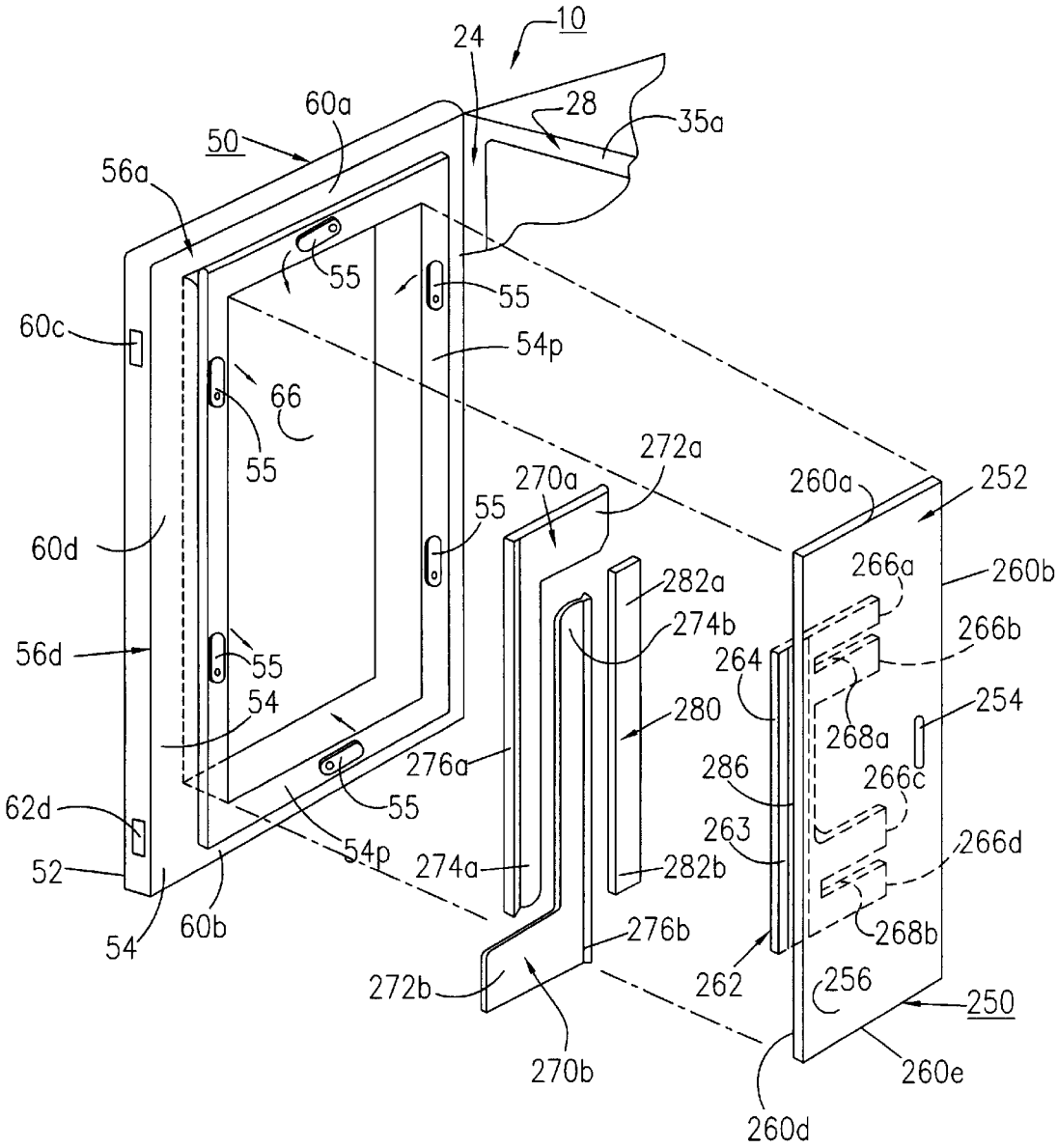
FIG. 14 is an exploded perspective view of the portable file case holder of the present invention showing the interior side of the detachable file case door receiving the broken-down lectern top assembly and its component parts within the storage cavity of the file case door therein.
Figure 15:
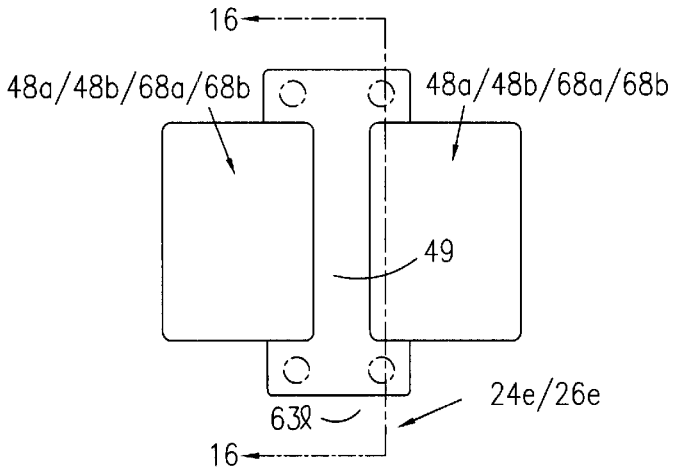
FIG. 15 is an enlarged partial front view of the portable file case holder of the present invention showing a single file case handle attached to the outer side wall of the case housing.

The lectern top assembly 250, as shown in FIG. 14, is filly collapsible and easily broken down to its component parts for storage within the lectern top storage compartment 66 located on the interior wall surface 52 of the detachable file case door 50. The lectern top assembly 250 is secured and held in place by a plurality of retaining clips 55, as shown in FIG. 1 of the drawings.

Figure 17:
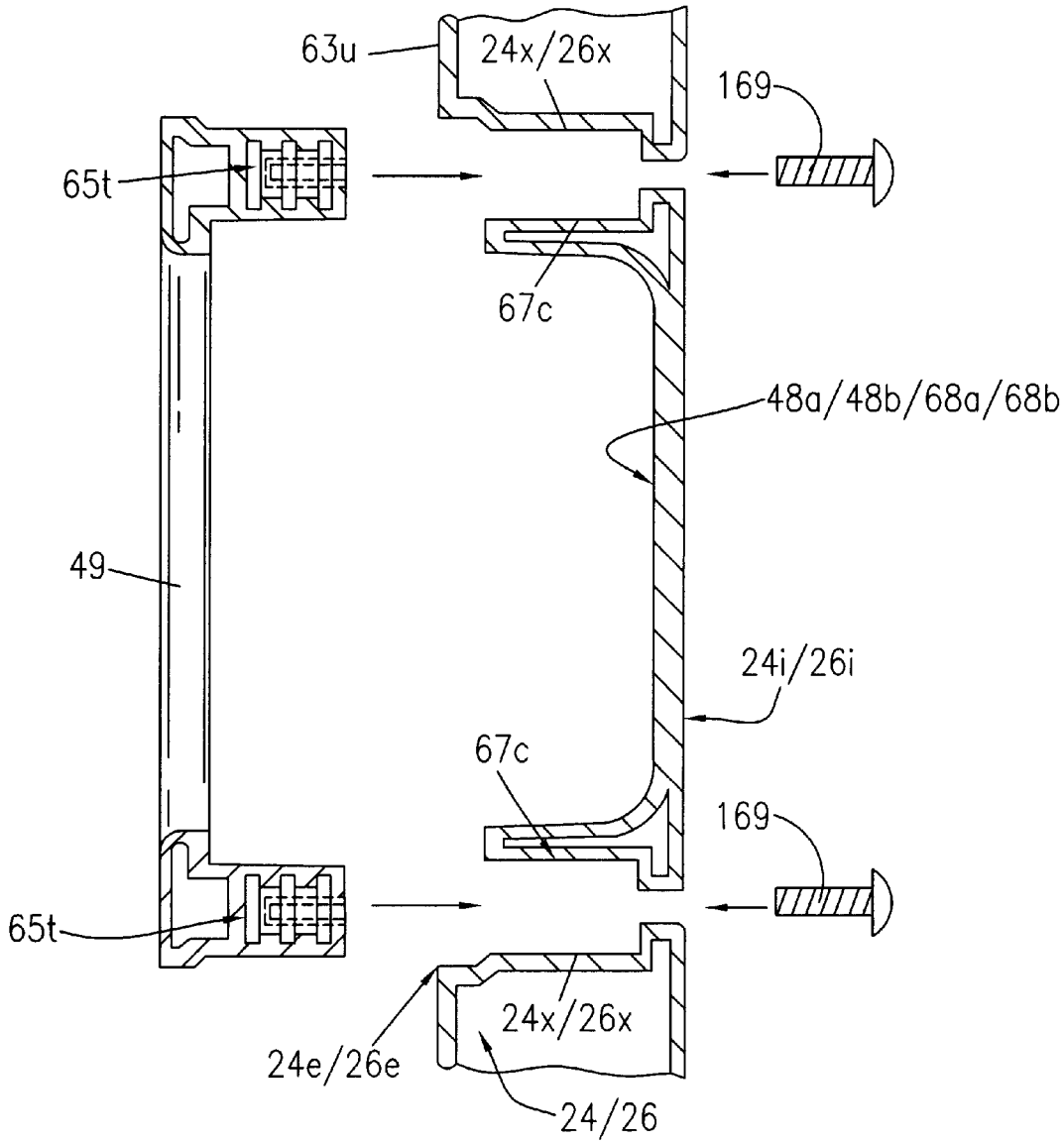
FIG. 17 is an enlarged exploded cross sectional view of the portable file case holder of the present invention taken along lines 16—16 of FIG. 15 showing the threaded inserts for the file case handle being attached to the side wall of the case housing.
Figure 18:
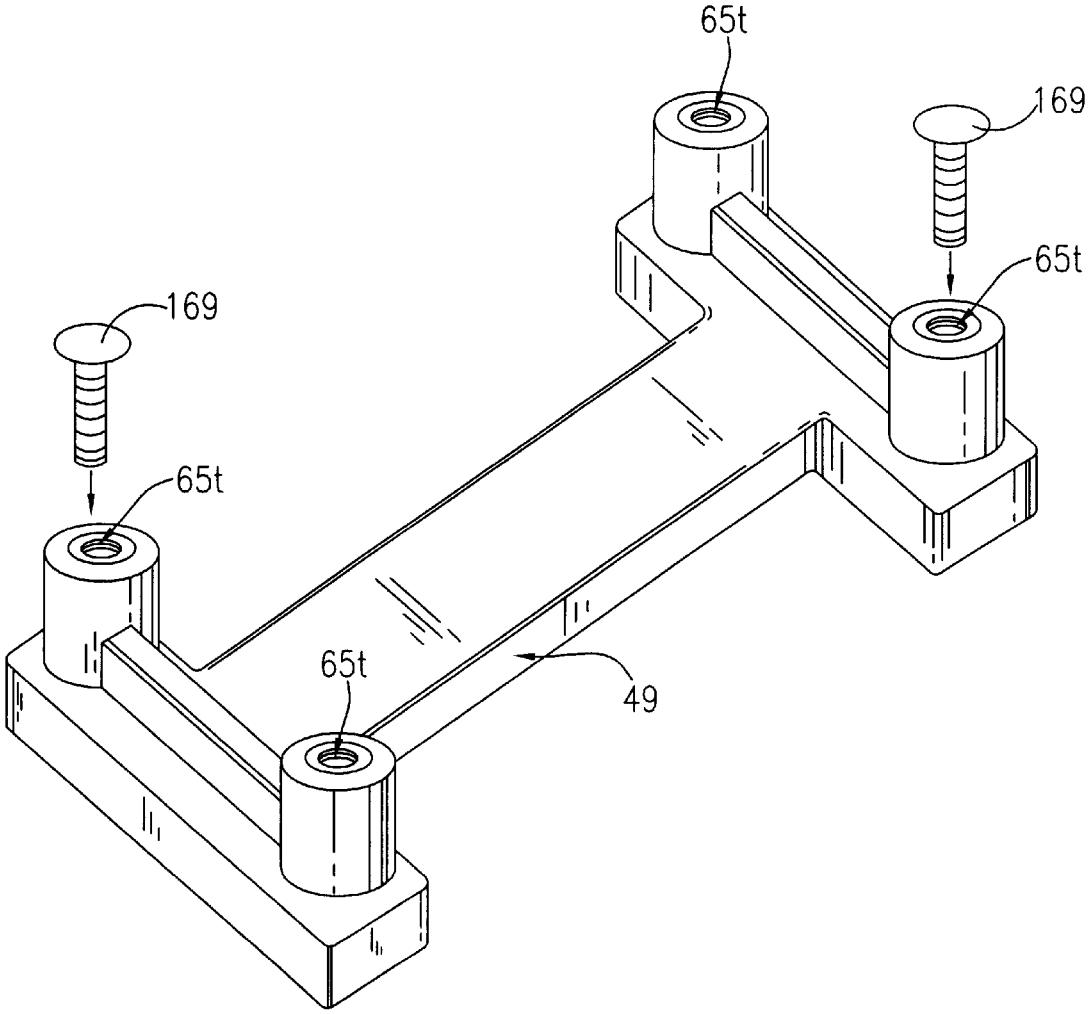
FIG. 18 is a rear perspective view of the portable file case holder of the present invention showing the file case handle.
Figure 19:
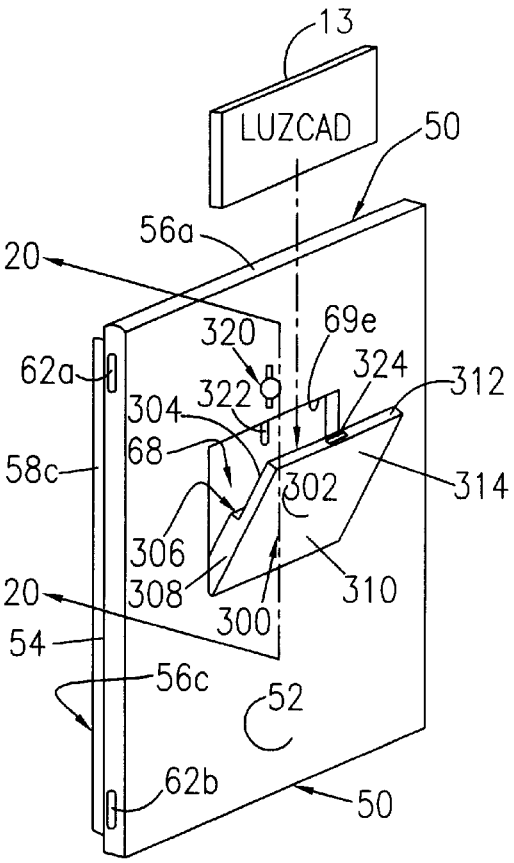
FIG. 19 is a front perspective view of the portable file case holder of the present invention showing the detachable file case door having a removable envelope door/pouch with a door storage compartment within the exterior side of the file door.
Figure 20:
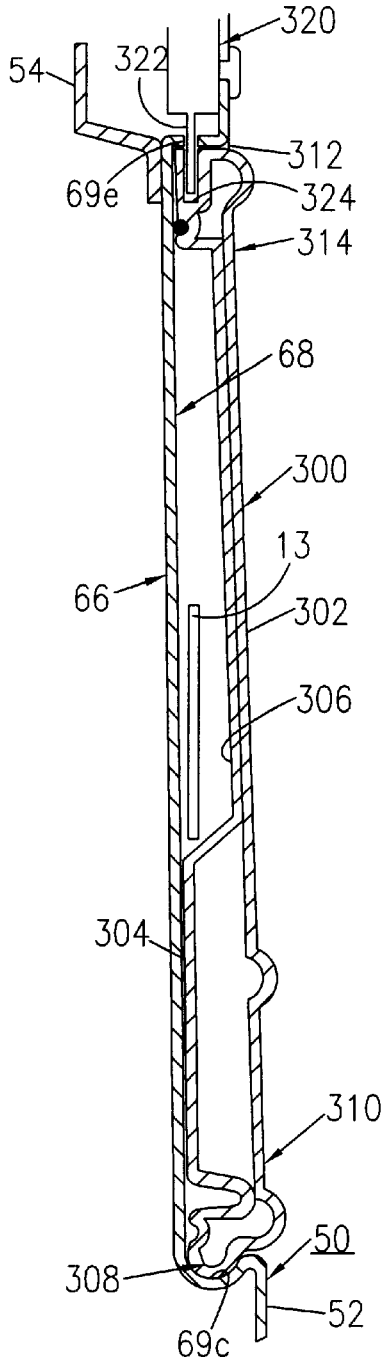
FIG. 20 is a cross-sectional view of the portable file case holder of the present invention taken along lines 20—20 of FIG. 19 showing the detachable file case door and its storage compartments, and the removable envelope door attached thereto.

The removable envelope door 300, as shown in FIGS. 4, 17 and 18 of the drawings, includes an exterior wall surface 302, an interior wall surface 304 and a holding (cut-out) area opening 306 for containing envelopes and/or business cards 13 therein. The removable envelope door 300 further includes a pivot member edging 308 located at the lower end 310 of door 300 and a clasping member edging 312 located at the upper end 314 of door 300. The pivot member edging 308 is received within the pivot cavity 69*c* of door storage compartment 68 and the clasping member edging 312 is received within clasping edge 69*e* of door storage compartment 68. The latching tab member 322 of latch lock member 320 is received within the latch channel 324 for shutting the envelope door 300 to a closed position, as depicted in FIG. 18 of the drawings.

Case housing 20 and detachable file case door 50 can be manufactured and molded by form or injection molding processes using durable plastic materials or by metal stamping using light-weight, durable metals. Durable plastic materials are selected from the group consisting of nylons, polyethylenes, polyproplylenes, polyurethanes, polyamides, Teflons™, and combinations thereof. Light-weight metals are selected from the group consisting of aluminum and stainless steel. Similarly, shelving members 100, 120, 140 or 160 can also be manufactured and molded by form or injection molding processes using durable and rigid plastic materials or by metal stamping using light-weight, durable metals, using the aforementioned plastic and metal materials.

The physical measurements of the case housing 20 and file case holder 10 of the present invention is as follows: the vertical height measurement of rear wall 22, and side walls 24 and 26 is approximately 33 inches ±¼ of an inch having a range of 30 inches to 36 inches; the horizontal width measurement of rear wall 22, top wall 28 and bottom wall 30 is approximately 17 inches ±¼ of an inch having a range of 14 inches to 20 inches; the depth measurement of side walls 24 and 26, top wall 28 and bottom wall 30 is approximately 13 inches ±¼ of an inch having a range of 10 inches to 16 inches; and the wall thickness measurement of rear wall 22, side walls 24 and 26, top wall 28 and bottom wall 30 is approximately 1½ inches ±¼ of an inch. File case door 50 has a height measurement of approximately 33 inches ±¼ of an inch having a range of 30 inches to 36 inches, width measurement of approximately 17 inches ±¼ of an inch having a range of 14 inches to 20 inches and a wall thickness of approximately 3 inches ±¼ of an inch having a range of 2 inches to 4 inches. The lectern top storage compartment 66 has an approximate height measurement of 27 inches, a width measurement of 12 inches and a depth measurement of 1¼ inches. The door/pouch storage compartment 68 has an approximate height measurement of 14 inches, a width measurement of 12 inches and a depth measurement of 1 inch. Interior compartment 32 has a height measurement of 30 inches, a width measurement of 11½ inches with the case door 50 off or a depth measurement of 10 inches with the case door 50 on.

Optionally, case housing 20 can be molded such that the outer and inner walls are metal having a foam core, with the metal wall thickness each being in the range of 1/16 of an inch to ⅛ of an inch and foam core thickness in the range of 1 inch to 1¼ inches.

Mounting bracket 236*a* to 236*f* has a length measurement of at least 10 inches, a width measurement in the range of ½ of an inch to ¾ of an inch and a thickness measurement in the range of ¼ of an inch to ½ of an inch. Shelving members 100, 120 or 140 have a width measurement in the range of 13¼ inches to 13¾ inches, a depth measurement in the range of 9½ inches to 10 inches and a wall thickness in the range of ⅛ of an inch to ¼ of an inch (depending upon the material used).

Wheel assembly 70 of case housing 20 has the following physical measurements, tire wheel 72 and 82 diameter in the range of 4 inches to 6 inches and tire wall thickness in the range of ¾ of an inch to 1 inch. Wheel strut has a length measurement in the range of 7 inches to 9 inches, a height measurement in the range of 2 inches to 3 inches, and a wall thickness in the range of ⅛ of an inch to ¼ of an inch (depending upon the material used).

Case handle 92 has a height measurement in the range of 12 inches to 16 inches, a width measurement in the range of 8 inches to 10 inches, and a wall thickness in the range of ¼ of an inch to ¾ of an inch (depending upon the material used).

OPERATION OF THE PRESENT INVENTION

In operation, starting from an empty mode, as shown in FIGS. 2 and 4 of the drawings, the portable file case holder 10 is loaded for transport in the following steps. The first step is to form the necessary compartments 110, 130, 150 or 170 using shelving members 100, 120, 140 or 160, respectively, depending upon the material contents to be transported with such content items as file folders 12, books 14, 3-ring binders 16 and/or transcripts 18 to be loaded, as depicted in FIGS. 1 and 1A of the drawings.

The next step is loading the aforementioned content items 12, 14, 16 and 18 within the frame assembly 38 and compartments 110, 130, 150 or 170 as necessary, as depicted in FIG. 1 of the drawings. The user then attaches and locks the detachable file case door 50 to case housing 20 via locks 62*a* and 64*a*, 62*b* and 64*b*, 62*c* and 64*c* and 62*d* and 64*d* in preparation to transport, as shown in FIG. 3 of the drawings.

In the next step, the user unlocks each wheel locking member 78 and 88 by turning knobs 80 and 90 in a counter-clockwise motion. This then loosens wheel struts 74 and 84, such that the user can then extend each tire wheel 72 and 82 outwardly, as shown in FIGS. 1 and 2 of the drawings. The user then tightens turning knobs 80 and 90 in a clockwise motion in order to fixedly position tire wheel and wheel strut 72 and 74 and 82 and 84 in its fully extended position in preparation for manual transport of file case holder 10 from one location to another location. Concurrently, the user also unlocks the handle locking member 96 from handle well 23 and lifts case handle member 92 to a fully extended position, where then the user tightens handle locking member 96 to a locked positioned, as shown in FIGS. 1 and 3 of the drawings, in preparation for manual transport of a file case holder 10 from one location to another location.

In the last step, the user then grabs case handle member 92 firmly and tilts the closed file case holder 10 to a 45° degree angle moves the file case holder 10 and its material contents, 12, 14, 16 and 18 from one location to another location. Once the user is at his/her second location, the user simply reverses the aforementioned steps of retracting the case handle member 92 and wheel assembly 70 for ease of storage and stabilization of the file case holder 10 in the process of being transported from one location to another (i.e., in the trunk of the user's car).

Once at a third location, the user can simply unlock the locks 62*a* and 64*a*, 62*b* and 64*b*, 62*c* and 64*c* and 62*d* and 64*d* from the detachable file case door 50, and removes file case door 50 from case housing 20, where then the user can remove the material contents 12, 14, 16 and 18 from the interior frame assembly 38 and compartments 110, 130, 150 or 170, accordingly. If the user likes, he or she can them remove all shelving 100, 120, 140 or 160 from the interior frame assembly 38, as shown in FIGS. 4 and 5 of the drawings.

When the portable file case holder 10 is to be used in a business conference or a judicial proceeding, the lectern top assembly 250 can be optionally deployed for the user's convenience in presenting his or her speech or oration and the like using the materials stored within the compartments 110, 130, 150 or 170, as depicted in FIGS. 1, 1A, 2 and 12 of the drawings. The user simply unclips and/or turns the retaining clips 55 to a non-holding position and removes the lectern top assembly 250 from its storage compartment 66 on the interior wall surface 54 of file case door 50, as shown in FIG. 14 of the drawings. The user then slides and places each of the dove tailed-shaped tab members 276*a* and 276*b* of the L-shaped support brackets 270*a* and 270*b* into the spaced-apart dove-tailed grooved channels 44*a* and 44*b*, respectively, on top wall 28 of case housing 20. Each of the side support brackets 270*a* and 270*b* are aligned and placed on the entire top wall 28, as depicted in FIG. 2 of the drawings. The user then places the slotted grooves 268*a* and 268*b* of the front U-shaped support bracket 262 onto each vertical section member 272*a* and 272*b* of side support brackets 270*a* and 270*b*, respectively, such that the lower perimeter edges 266*a* to 266*d* of the front U-shaped support bracket 262 are in contact with the top exterior wall surface 28*e* of the case housing 20. In the final assembly step, the user then places the first end 282*a* of the support brace 280 within the bracing slot opening 254 and the second end 282*b* of the support brace 280 within a portion of the handle opening 93 of the case handle member 92 in which to support the lectern tabletop 252 at a 45° angle for holding of books, papers, legal documents, etc. and the like on the front wall surface 256, as shown in FIGS. 2 and 12 of the patent drawings.

In using the removable envelope door 300, the user simply pushes upward on the latch lock member 320, where then the envelope door 300 pops open in which the user can then store business cards, envelopes, folded documents and the like within the storage and holding area opening 306 of envelope door 300. When finished, the user simply closes the envelope door 300 inwardly and latches the lock member 320 in place via the latching tab member 322 within the latch channel 69*g*, as depicted in FIG. 18 of the drawings.

ADVANTAGES OF THE PRESENT INVENTION

Accordingly, an advantage of the present invention is that it provides for a portable file case holder for the manual transporting of file folders, transcripts, books, manuscripts, notebooks, computer printouts and the like.

Another advantage of the present invention is that it provides for a portable filing case that includes extendable wheels and handle for the ease of movement when transporting the file case holder from one location to another location (i.e. from the user's car to the airport luggage check-in).

Another advantage of the present invention is that it provides for a portable filing case that includes retractable wheels and handle for ease of storage and stabilization of the file case holder when not being transported (or used) from one location to another location (i.e., when in the user's trunk or storage area; or when being transported in the cargo-hole of an airplane).

Another advantage of the present invention is that it provides for a portable filing case that includes detachable, removable and stackable shelving members for forming compartments for ease of handling and storing of the file case contents within each of the compartments.

Another advantage of the present invention is that it provides for a portable filing case that includes locking elements or connecting means for attaching and connecting the one or more of the removable shelving members to the mounting brackets of the frame assembly within file case holder such that the shelving members do not become detached from the mounting brackets of the frame assembly when the user is manually transporting the portable file case holder from one location to another location.

Another advantage of the present invention is that it provides for a portable filing case that includes an air tight detachable file case door with locks for securely locking of the file case contents therein, when the file case is in a transport mode.

Another advantage of the present invention is that it provides for a portable filing case that includes a lectern top assembly for use in court proceedings or business meetings, wherein the lectern top assembly is slidably attached to the top wall of the case housing.

Another advantage of the present invention is that it provides for a portable filing case that includes a lectern top accessory that is completely collapsible and easily broken-down, such that the lectern top assembly is stored in a storage compartment in the interior wall surface of the detachable file case door.

Another advantage of the present invention is that it provides for a portable filing case that includes a second storage compartment and a removable envelope door for storing business cards, envelopes, and general correspondence, being located on the exterior wall surface of the detachable file case door.

Another advantage of the present invention is that it provides for a portable filing case that is long-lasting, durable and light-weight being made from moldable plastic or metal such as aluminum or stainless steel.

A further advantage of the present invention is that it provides for a portable file case holder that can be mass produced in an automated and economical manner and is readily affordable by the consumer/user.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A portable file case holder, comprising:

a) a case housing having a rear wall, side walls, a top wall and a bottom wall for forming an interior compartment; said rear wall having an exterior wall surface and an interior wall surface; each of said side walls having an exterior wall surface and an interior wall surface;

b) each of said side interior wall surfaces include means for mounting; wherein said means for mounting include connecting means thereto for receiving a shelving member;

c) one or more of said shelving members for forming one or more compartments within said interior compartment of said case housing for receiving documents in the form of file folders, books, notebooks, 3-ring binders, manuscripts, transcripts, and/or computer print-outs;

d) said case housing including a detachable file case door having an exterior wall surface, an interior wall surface and a perimeter edging with a plurality of locking means thereon for covering said interior compartment;

e) each of said side exterior wall surfaces include a wheel receiving compartment; each of said wheel receiving compartments for receiving a tire wheel and wheel strut having strut locking means thereon;

f) each of said tire wheel and wheel strut having a first wheel retracted position within said wheel receiving compartment and a second wheel extended position extending from said wheel receiving compartment;

g) said rear exterior wall surface includes a handle receiving compartment; said handle receiving compartment for receiving a case handle member having a handle locking means thereon;

h) said case handle member having a first handle retracted position within said handle receiving compartment and a second handle extended position extending from said handle receiving compartment;

i) a detachable and collapsible lectern top assembly, said lectern top assembly includes a lectern tabletop having a bracing slot opening, said lectern tabletop being hingedly connected to a front support bracket, a pair of side support brackets, and a support brace having an upper end and a lower end; and j) said top wall includes a pair of spaced-apart grooved channels for slidably receiving said pair of side support brackets, respectively.

2. A portable file case holder in accordance with claim 1, wherein said means for mounting include a plurality of spaced-apart sets of mounting receiving slots being molded with each of said side interior wall surfaces.

3. A portable file case holder in accordance with claim 2, wherein said connecting means for each set of mounting receiving slots include U-shaped channels for receiving a shelving member therein.

4. A portable file case holder in accordance with claim 1, wherein said means for mounting include a plurality of paired, spaced-part mounting brackets being fixedly attached to each of said side interior wall surfaces.

5. A portable file case holder in accordance with claim 4, wherein said connecting means of each of said paired mounting brackets include U-shaped channels for receiving said shelving member therein.

6. A portable file case holder in accordance with claim 1, wherein said shelving member includes a bottom wall surface having mounting tabs thereon.

7. A portable file case holder in accordance with claim 6, wherein said connecting means of each of said paired mounting brackets include a pair of mounting ports thereon for receiving of said mounting tabs of said shelving member.

8. A portable file case holder in accordance with claim 1, wherein said shelving member includes a bottom wall surface having a pair of insert tab members thereon and a top wall surface having a pair of J-shaped clamping members thereon.

9. A portable file case holder in accordance with claim 8, wherein said connecting means of each of said paired mounting brackets include mounting insert slots thereon for receiving of said insert tab members of said shelving member and for receiving of said J-shaped clamps of said shelving member on each of said paired mount brackets thereto.

10. A portable file case holder in accordance with claim 1, wherein said rear interior wall surface includes secondary means for mounting; wherein said secondary means for mounting include said connecting means thereto for receiving said shelving member for providing additional stability to said shelving members when loaded with documents in the form of file folders, books, notebooks, 3-ring binders, manuscripts, transcripts and/or computer printouts.

11. A portable file case holder in accordance with claim 10, wherein said secondary means for mounting include a plurality of spaced-apart mounting receiving slots being molded within said rear interior wall surface.

12. A portable file case holder in accordance with claim 10, wherein said secondary means for mounting include a plurality of spaced-apart mounting brackets being fixedly attached to said rear interior wall surface.

13. A portable file case holder in accordance with claim 1, wherein said plurality of locking means for said detachable file case door includes a plurality of lock receiving slots on said perimeter edging of said detachable file case door.

14. A portable file case holder in accordance with claim 13, wherein each of said side exterior wall surfaces include a pair of catch locking members thereon for connecting and locking with said plurality of lock receiving slots of said detachable file case door in order to completely close said file case door on said interior compartment of said case housing.

15. A portable file case holder in accordance with claim 1, wherein said strut locking means includes a strut locking member having a turning knob mounted on a threaded bolt in order to lock said tire wheel and wheel strut in either said first wheel retracted position or in said second wheel extended position.

16. A portable file case holder in accordance with claim 1, wherein said handle locking means includes a handle locking member having a turning knob mounted on a threaded bolt in order to lock said case handle member in either said first handle retracted position or in said second handle extended position.

17. A portable file case holder in accordance with claim 1, wherein said top wall includes a file card display compartment for receiving a file card.

18. A portable file case holder in accordance with claim 1, wherein said upper end of said support brace is received within said bracing slot opening of said lectern tabletop and said lower end of said support brace is received and braced against said case handle member in which to support said lectern tabletop in a 45° degree angle when in a fully assembled state.

19. A portable file case holder in accordance with claim 1, wherein said interior wall surface of said file case door includes a first storage compartment for receiving said detachable and collapsible lectern top assembly therein.

20. A portable file case holder in accordance with claim 19, wherein said interior wall surface of said file case door includes a plurality of retaining clips for holding and securing said lectern top assembly within said first storage compartment for preventing said lectern top assembly from moving when in a transport mode.

21. A portable file case holder in accordance with claim 1, wherein said exterior wall surface of said file case door includes a second storage compartment for receiving a detachable envelope door therein, said second storage compartment and said detachable envelope door is used for storing of business cards, envelopes and correspondence therein.

22. A portable file case holder in accordance with claim 21, wherein said exterior wall surface of said file case door includes door locking means for shutting said envelope door to a closed position.

23. A portable file case holder in accordance with claim 22, wherein said door locking means includes a latching lock thereon.

24. A portable file case holder in accordance with claim 1, wherein said tire wheels are made of plastic or rubber.

25. A portable file case holder in accordance with claim 1, wherein said wheel struts are make of plastic or metal.

26. A portable file case holder in accordance with claim 1, wherein said file case holder is made of durable plastics or light-weight metals.

27. A portable file case holder in accordance with claim 26, wherein said durable plastics are selected from the group consisting of nylons, polyethylenes, polyproplylenes, polyurethanes, polyamides, polytetrafluoroethylenes, and combinations thereof.

28. A portable file case holder in accordance with claim 26, wherein said light-weight metals are selected from the group consisting of aluminum and stainless steel.

29. A portable file case holder in accordance with claim 1, wherein each of said side exterior wall surfaces of said side walls further include one or more carrying handle compartments for receiving therein a carrying handle in order to lift said portable file case holder from one position to another position.

30. A portable file case holder in accordance with claim 29, wherein said side walls include a plurality of insert holding chambers for receiving thread insert elements therein for attaching said carrying handles to said one or more carrying handle compartments by screws.

31. A portable file case holder in accordance with claim 1, wherein said case housing has a height measurement in the range of 30 inches to 36 inches; has a width measurement in the range of 14 inches to 20 inches; has a depth measurement in the range of 10 inches to 16 inches; and has a thickness measurement in the range of 1¼ to 1¾ inches.

32. A portable file case holder in accordance with claim 1, wherein said interior compartment has a height measurement of 30 inches, a width measurement of 11½ inches and a depth measurement of 10 inches.

33. A portable file case holder in accordance with claim 1, wherein said file case door has a height measurement in the range of 30 inches to 36 inches; has a width measurement in the range of 14 inches to 20 inches; and has a thickness measurement in the range of 2 inches to 4 inches.

34. A portable file case holder in accordance with claim 1, wherein said mounting bracket has a length measurement of at least 10 inches, a width measurement in the range of ½ of an inch to ¾ of an inch and a thickness measurement in the range of ¼ of an inch to ½ an inch.

35. A portable file case holder in accordance with claim 1, wherein said shelving member has a width measurement in the range of 13¼ inches to 13¾ inches, a depth measurement in the range of 9½ inches to 10 inches and a wall thickness in the range of ⅛ of an inch to ¼ of an inch.

36. A portable file case holder in accordance with claim 1, wherein said tire wheel has a diameter in the range of 4 inches to 6 inches and has a tire wall thickness in the range of ¾ of an inch to 1 inch.

37. A portable file case holder in accordance with claim 1, wherein said wheel strut has a length measurement in the range of 7 inches to 9 inches, height measurement in the range of 2 inches to 3 inches, and a wall thickness in the range of ⅛ of an inch to ¼ of an inch.

38. A portable file case holder in accordance with claim 1, wherein said case handle member has a height measurement in the range of 12 inches to 16 inches, a width measurement in the range of 8 inches to 10 inches, and a wall thickness in the range of ¼ of an inch to ¾ of an inch.

* * * * *